US010035058B1

(12) United States Patent
Ritter

(10) Patent No.: US 10,035,058 B1
(45) Date of Patent: Jul. 31, 2018

(54) BOOT BINDING SYSTEM WITH FOOT LATCH PEDAL

(71) Applicant: SPARK R&D IP HOLDINGS, LLC, Bozeman, MT (US)

(72) Inventor: William J Ritter, Bozeman, MT (US)

(73) Assignee: SPARK R&D IP HOLDINGS, LLC, Bozeman, MT (US)

( * ) Notice: Subject to any disclaimer, the term of this patent is extended or adjusted under 35 U.S.C. 154(b) by 0 days.

(21) Appl. No.: 15/402,118

(22) Filed: Jan. 9, 2017

Related U.S. Application Data

(63) Continuation-in-part of application No. 14/815,432, filed on Jul. 31, 2015, now Pat. No. 9,573,043, which is a continuation of application No. 14/142,433, filed on Dec. 27, 2013, now Pat. No. 9,126,099.

(60) Provisional application No. 61/778,329, filed on Mar. 12, 2013, provisional application No. 61/757,216, filed on Jan. 27, 2013.

(51) Int. Cl.
*A63C 10/20* (2012.01)
*A63C 9/08* (2012.01)
*A63C 9/00* (2012.01)

(52) U.S. Cl.
CPC ..... *A63C 9/0807* (2013.01); *A63C 9/002* (2013.01); *A63C 10/20* (2013.01)

(58) Field of Classification Search
CPC ..... A63C 10/18; A61B 17/0469
USPC ..... 280/623, 818, 603, 14.26, 14.24, 14.21
See application file for complete search history.

(56) References Cited

U.S. PATENT DOCUMENTS

| | | | | | |
|---|---|---|---|---|---|
| 5,114,172 | A * | 5/1992 | Rousset | A63C 9/00 | 280/615 |
| 5,884,933 | A * | 3/1999 | Trott | A63C 5/03 | 280/14.22 |
| 5,984,324 | A * | 11/1999 | Wariakois | A63C 5/02 | 280/14.24 |
| 6,315,305 | B1 * | 11/2001 | Gien | A63C 10/22 | 280/11.26 |
| 6,523,851 | B1 * | 2/2003 | Maravetz | A63C 5/02 | 280/14.22 |
| 8,708,371 | B2 * | 4/2014 | Balun | A63C 5/033 | 280/14.21 |
| 2007/0216137 | A1 * | 9/2007 | Ritter | A63C 5/02 | 280/623 |
| 2008/0185814 | A1 * | 8/2008 | Riepler | A63C 5/02 | 280/601 |
| 2009/0250906 | A1 * | 10/2009 | Ritter | A63C 5/02 | 280/623 |

(Continued)

*Primary Examiner* — James A Shriver, II
*Assistant Examiner* — Brian L Cassidy
(74) *Attorney, Agent, or Firm* — Stone Creek Services LLC; Alan M Flum

(57) ABSTRACT

A boot binding system for a splitboard that can include a latch pedal mechanism at an end of a baseplate on which the rider's boot rests. The latch pedal can have a dual function: either to attach each boot binding to a ride mode interface, or to attach each boot binding to a ski tour interface. In a "release position" the latch pedal is disengaged allowing the baseplate assembly to alternate between the ski tour interface and the ride mode interface. In a "lock position," the rider depresses the latch pedal and locks the boot binding onto the selected interface. The latch pedal is held down by the rider's boot when in the lock position, contributing to the system's lightness and strength.

5 Claims, 23 Drawing Sheets

© 2016 William Ritter (17 U.S.C. 401)

(56) References Cited

U.S. PATENT DOCUMENTS

| | | | | |
|---|---|---|---|---|
| 2012/0256395 | A1* | 10/2012 | Ritter | A63C 5/02 280/623 |
| 2012/0274036 | A1* | 11/2012 | Kloster | A63C 5/0411 280/11.31 |
| 2015/0014962 | A1* | 1/2015 | Rayner | A63C 10/145 280/611 |

* cited by examiner

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

TOP

BOTTOM

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

© 2016 William Ritter (17 U.S.C. 401)

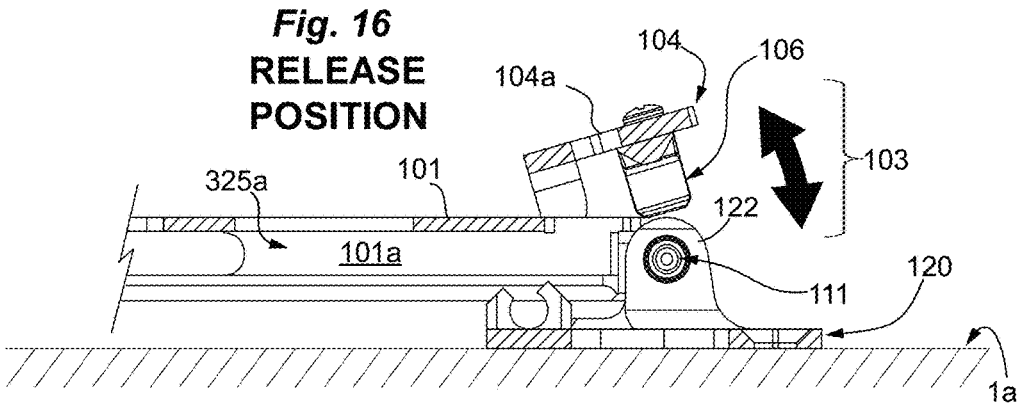
Fig. 16
RELEASE
POSITION
104
106
104a
103
325a
101
122
101a
111
120
1a
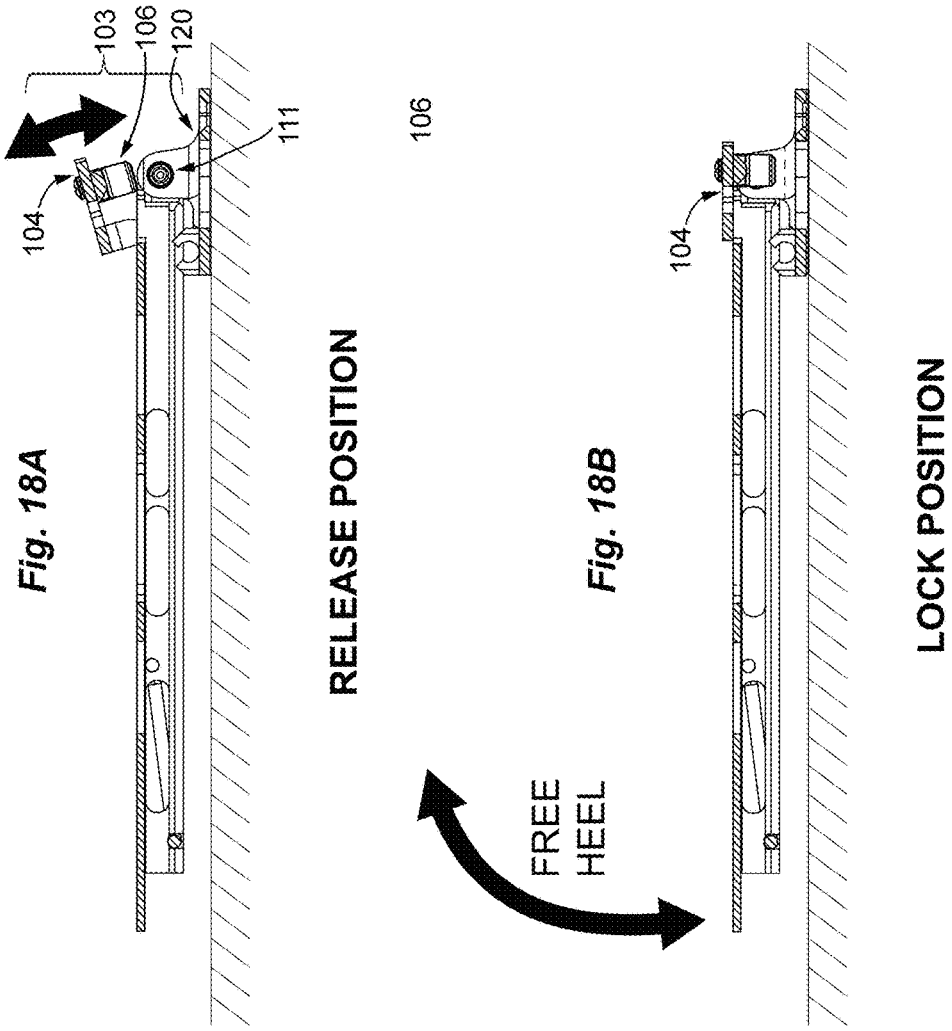
103
106
120
111
104
Fig. 18A
RELEASE POSITION
106
FREE
HEEL
Fig. 18B
104
LOCK POSITION © 2016 William Ritter (17 U.S.C. 401)

© 2016 William Ritter (17 U.S.C. 401)

Table II. Torsional Spring Constants K

| | K (in-lb/degree) |
|---|---|
| (501) PRIOR ART | 145 |
| (502) EXEMPLARY ARTICLE | 218 |

© 2016 William Ritter (17 U.S.C. 401)

BOOT BINDING SYSTEM WITH FOOT LATCH PEDAL

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS REFERENCE TO RELATED APPLICATIONS

This application is a continuation-in-part of and claims benefit of U.S. patent application Ser. No. 14/815,432, filed 31 Jul. 2015, entitled "Boot Binding System with Foot Latch Pedal,", which is a continuation of and claims priority to U.S. patent application Ser. No. 14/142,433, filed 2013 Dec. 27; which claims benefit of U.S. Provisional Patent No. 61/778,329, filed 2013 Mar. 12, and of U.S. Provisional Patent No. 61/757,216, filed 2013 Jan. 27, said patent documents being herein incorporated in full by reference for all purposes. Also related in content are U.S. Pat. Nos. 7,823,905, 8,225,109, 9,022,412, 9,126,099, 9,220,968, 9,452,344, and U.S. patent Ser. Nos. 15/004,085 and 15/009,604, which are co-owned, all said patent documents being herein incorporated in full by reference for all purposes.

GOVERNMENT SUPPORT

Not Applicable.

FIELD OF THE INVENTION

The invention relates generally to boot binding systems with interfaces for splitboards used in winter sports. More particularly, the invention relates to boot binding systems built on a modified it-girder baseplate and having a foot latch pedal.

BACKGROUND

Backcountry splitboarding is a popular sport with a dedicated following. When fully assembled, a splitboard looks like a snowboard, but can be taken apart to form a pair of skis. The right and left "skis" of a splitboard are asymmetrical; i.e., they are the mirror halves of a snowboard—longitudinally cut (or "split"), and typically have the sidecut (i.e., nonlinear long edges) and camber of snowboards. When worn separately as a pair of skis the rider can tour cross-country and climb through soft snow more quickly than by hiking. By joining the ski halves together, the rider descends as if riding a snowboard. The rider's stance in the snowboard riding configuration is sideways on the board, with legs spread for balance.

Because of the combination of functions, such that the splitboard is sometimes used for skiing and other times for snowboarding, a great deal of ingenuity has been required in developing boot bindings that can be used in both "ski mode", where the skis are used separately, and "ride mode", where the boot bindings form part of a rigid union between the two ski halves. In both cases, the boot binding may include straps or bails, a heel or toe riser, a heel loop, a highback, and so forth to comfortably secure the boot to the board. Most modern riders use soft boots and flex at the knees and ankles to shift their weight and maneuver the board.

The earliest patent applications on splitboards were filed by Ueli Bettenman starting in about 1988, and include Intl. Pat. Nos. CH681509, CH684825, German Gebrauchsmuster DE9108618 and EP0362782B1. In addition to the basic splitboard concept, these patents include drawings of splitboard bindings, both of a slidingly engageable rail type and a rotational clamping type, the bindings serving to secure the rider's boots to the skis in ski mode and the snowboard in ride mode.

The earliest efforts at commercialization were made by Snowhow (Thalwil, CH) in Europe, and with the collaboration of the Fritschi brothers, by Nitro Snowboards USA out of Seattle in the early 1990's. The Nitro snowboard binding consists of two slider tracks that join paired stationary flanged blocks mounted crosswise on each of the ski members. The binding bails are provided on a second plate which is hinged at the toe on the slider track and can be locked at the heel, thus enabling free heel ski mode when mounted parallel to the long axis of the ski members and ride mode when mounted crosswise. Stabilizers to hold the tips of the ski members together in ride mode include pairs of buckles.

Also an early contributor was Stefan Schiele, who filed Intl. Pat. Publication WO 98/17355 in 1996 on a three-part board joined by a rigid crosspiece at each foot, each crosspiece engaging three elevated pins with rotatable locking elements and having mating hooks at the ends of the boards. In ski mode, the skier carries the middle piece strapped to his backpack. Commercialization of this product, known as "System T3" continues.

Subsequently, Voile Manufacturing of Salt Lake City filed for a patent on an improved splitboard binding interface. U.S. Pat. No. 5,984,324 describes a slider track with insertable toe pivot pin for each foot, the slider track joining pair of "pucks" mounted on each ski member when mounted crosswise and also serving as a pivotable member for free heel touring. This innovation resulted in substantial growth of interest in splitboarding in the United States and has had worldwide impact on the sport.

Ritter, in U.S. Pat. Nos. 7,823,905, 8,225,109, 9,220,968, 9,022,412, 9,126,099, 9,245,344, US Pat. Appl. Publ. No 2013/025395, and U.S. patent Ser. Nos. 15/004,085 and 15/009,604, disclosed structural features and methods related to a stiffer, lower and lighter binding for spanning pucks mounted crosswise on the splitboard. The lightweight binding includes a toe pivot for free heel skiing and touring and has gained international popularity among soft boot riders. These bindings are commercialized by Spark R&D of Bozeman MT.

Maravetz, in U.S. Pat. No. 6,523,851, abandoned the rail-type binding in favor of a clamp designed to engage a pair of semi-circular flanged mounting blocks, one pair under each foot in ride mode. The two mounting blocks conjoin as a circle on which jaw mechanism can be adjusted to suit the foot angle of the rider. Boot bindings are attached to the upper surface of the clamp member. Interestingly, the jaw of the clamp operates to tighten itself against the board and pull the two ski members together. However, the complexity of the mechanism is a disadvantage in that impacted snow tends to interfere with its operation. The clamp is provided with a built in toe pivot mechanism that is used in ski mode. The board is stabilized with front and rear hooks that join the ski members.

U.S. Pat. No. 8,033,564 to Riepler was commercialized by Atomic (Altenmarkt Im Pongau, AT). The Atomic splitboard binding interface used a rotating plate to engage four mushroom pins affixed to the ski members under each of the rider's feet. The internal workings were mounted between two plates that made up the body of the binding. The built-in toe pivot pin was spring-loaded in a sealed cylinder and engaged a toe pivot cradle in ski mode. Ride mode was stabilized by front and rear buckles and tip hooks. The ski members were unique in that they were shaped with a pointed downhill tip and a rounded tail. A well-known drawback of this interface was the need for a special spanner tool to transfer the binding between ski mode and ride mode.

U.S. Pat. Publ. No. US2010/0102522 to Kloster discloses two binding interface systems that appear to combine a number of features, including buckles and hooks for stabilizing the ski tips in ride mode. The Kloster binding is commercialized by Karakoram (North Bend, Wash.). In ski mode, a non-detachable axle at the toe is engaged by a pair of jaws operated by a release lever built into the toe pivot cradle. To disengage the toe axle from the pivot cradle, the rider lifts his boot heel and reaches under his foot to pull up the release lever (or removes the boot and reaches through the binding). A doubly-hinged linker arm couples the rotation of the release lever and the disengagement of the locking jaw.

In ride mode, the toe end is affixed to a pair of tabs mounted on a first ski member and a side lever arm operated by the rider causes extendable rods at the heel end to engage brackets mounted to the second ski member. As the side arm lever is rotated and locked, the two ski members are pulled together. The ride mode engaging system is sealed in a gear box to prevent snow entry, which would jam the workings. In ski mode, the toe end engages a toe pivot interface and requires its own lever-operated clamping mechanism. The use of two separate mechanisms for the toe pivot and ride mode interfaces adds complexity and weight.

Thus, there is a need in the art for a splitboard binding interface that overcomes the above disadvantages and provides the further improvements as will be apparent from the disclosure contained herein.

BRIEF SUMMARY

Described is a boot binding system for a splitboard. The system includes a pair of boot bindings, each member of the pair having a modified it-girder and a baseplate-latch pedal combination for supporting the rider's boot. The baseplate combination includes a pivotable foot latch pedal mechanism at one end. The latching mechanism engages, in alternation, a ride mode interface and/or a ski tour interface mounted on a splitboard. The latch pedal mechanism operates to interchangeably secure the boot binding baseplate to either of the interfaces so that the rider may take turns in ski mode and ride mode. In ski mode, the foot latch pedal mechanism engages pintle pins or "axle stubs". In ride mode, a detent member may operate to capture the baseplate on a pair of mounting pucks. In ski mode, a detent member operates to lock the baseplate to pintle pins. In a RELEASE position the foot latch pedal mechanism is raised and disengaged so that the baseplate may be reversibly detached or switched between ski touring configuration and ride mode configuration. In a LOCK position, the rider locks each boot binding in ride mode or ski mode by depressing the foot pedal plate. The pedal remains under the boot when locked in place in either interface.

The foot pedal plate is pivotably mounted in a mounting box slot cut or otherwise formed at an end of the baseplate. Paired hinge arms or other pivot means allow the foot pedal plate to pivot from a first, raised position angled up from the baseplate to a second, depressed position such that the foot pedal plate is generally co-planar with the baseplate or slightly raised. When the foot latch pedal mechanism is up and open, the bindings may be removed from their attachment and repositioned for either ski mode or ride mode, or from one board to another. When the rider's foot or fingers are used to depress the pedal into its lock position, the boot binding is locked to the selected interface.

Advantageously, a single moving part serves multiple functions in engaging either of two interfaces and in providing boot sole support. The invention eliminates pins of the prior art that sometimes were lost during changeovers from touring to ride mode, and is robust, durable and resists snow impaction in the mechanism. The invention is an improvement over complex mechanisms of the prior art, some using separate locks for touring and ride mode, and is an advance in the art. The simplicity is reflected in that the locking mechanism may be actuated using only the rider's boot.

A boot binding and interface system of the invention typically will include two mounting interfaces: a ride mode interface and a ski mode interface. Both interfaces are used in alternation. Advantageously, a boot binding and interface system of the invention enables a splitboard rider to engage the ride mode interface or the ski mode interface interchangeably. Yet more advantageously, the foot latch pedal is enabled to be lockingly operated on either interface with a rider's hand or only a rider's boot.

In a preferred aspect, the ski mode interface comprises a toe pivot bracket or cradle having medial and lateral toe pivot ears, each of the toe pivot ears having a coaxial pivot hole transversely disposed therein, such that the toe pivot bracket is attachable to a splitboard. A pair of contralateral jaw members at a toe end of the boot binding baseplate seat flush by the toe pivot ears. Each of the jaw members is configured with a pintle pin configured to define a toe pivot axis extending co-axially crosswise through the jaw members. The pintle pins are oriented ipsilaterally so that both pintle pins are pointed in a common direction on each jaw member. The pintle pins are ipsilaterally disposed (each on the same side) on the jaw members and define a toe pivot axis when cooperatively inserted into the coaxial pivot holes of the toe pivot ears with a coordinated sideways installation motion.

Also provided is a method for transitioning a boot binding to and from a ride mode interface or a ski tour interface in alternation. The method includes steps for (a) providing a splitboard having a ride mode interface and a ski tour interface, (b) providing a boot binding baseplate having a foot latch pedal mechanism mounted thereon, the foot latch pedal mechanism comprising a pivotable foot pedal plate with detent member mounted thereon; and, (c) pivoting the foot pedal plate between a release position and a lock position when lockingly engaging either the ski mode interface or the ride mode interface in turn. The foot pedal plate has a top face used for applying the rider's hand or toe so as to lockingly engage an interface, and when locked in place, the foot pedal plate supports the rider's boot as part of the foot supporting surface of the binding.

Splitboard styles tend toward more aggressive line choices, more power edging, and abrupt maneuvering, necessitating an optimized torsional stiffness. A torsional spring built into the boot binding systems of the invention is engineered to meet these demands by soft boot riders.

The foregoing and other elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps and combinations thereof that characterize aspects the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 16 is a cutaway view drawn to expose the operation of the detent of afoot latch pedal.

FIGS. 18A and 18B are section views showing the operation of a foot latch pedal in ski tour mode.

Figure 1:
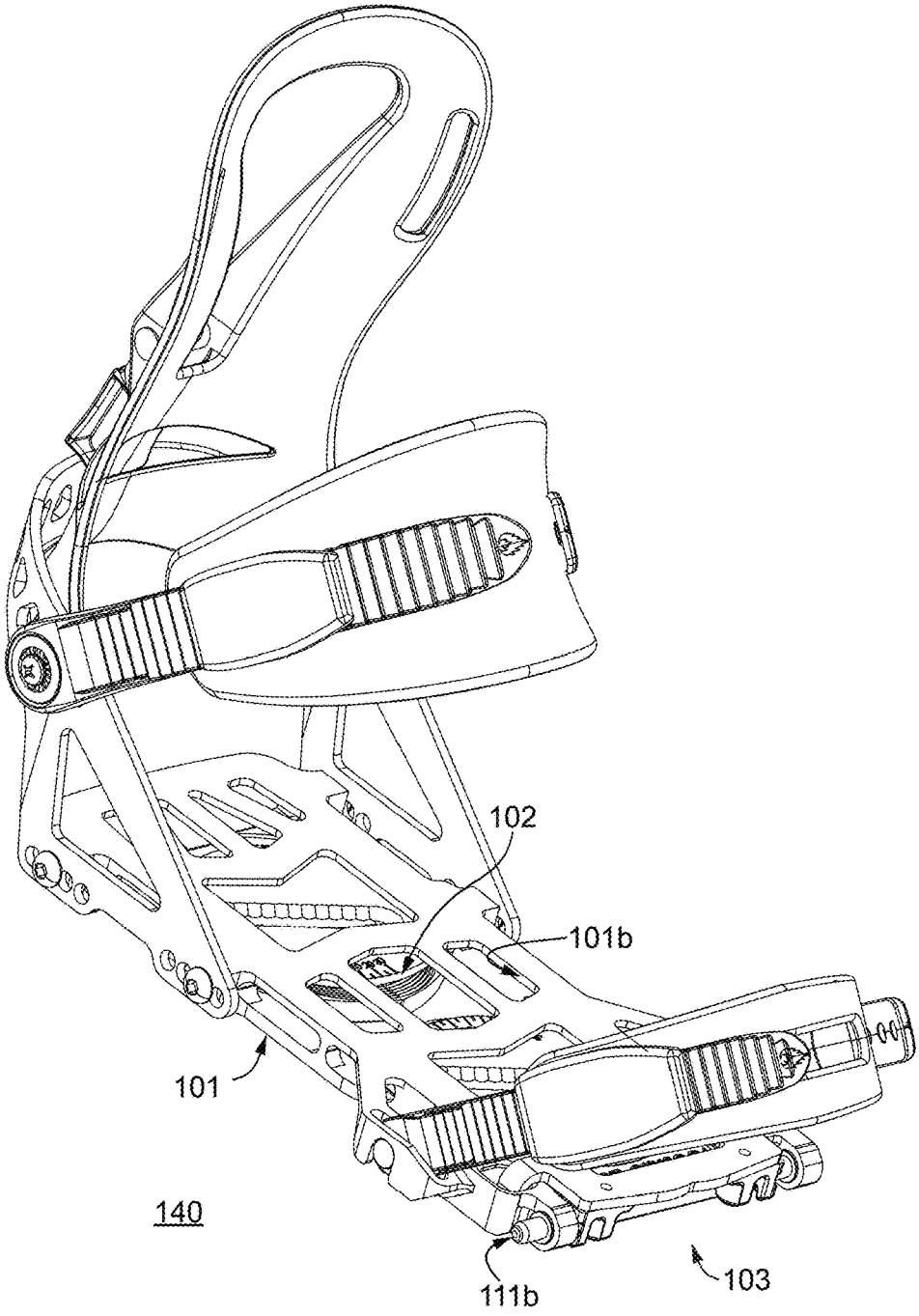
FIG. 1 is a perspective view of an exemplary boot binding system of the invention as configured on a ride mode interface.

The drawing figures are not necessarily to scale. Certain features or components herein may be shown in somewhat schematic form and some details of conventional elements may not be shown in the interest of clarity and conciseness. The drawing figures are hereby made part of the specification, written description, original claims and teachings disclosed herein.

DETAILED DESCRIPTION

Although the following detailed description contains specific details for the purposes of illustration, one of skill in the art will appreciate that many variations and alterations to the following details are within the scope of the claimed invention. The following definitions are set forth as an aid in explaining the invention as claimed.

Definitions and Terminology

"Splitboards" are essentially snowboards divided longwise into two ski members that function as skis when separated and can be rejoined together to form a single gliding board in the shape of a snowboard.

"Boot binding system": A boot binding system for splitboarding that generally includes a ski mode interface and as ride mode interface, and a pair of boot binding baseplates or equivalents, as well as boot binding uppers such as heel loops, highbacks, toe straps, ankle straps, and fasteners. By convention, each boot binding is weighed with heel loop, highback, ankle strap and toe strap in place, but without any mounting interface. If a climbing bar is part of the boot binding, it is included in the weight. Thus a claim to a boot binding having a weight of 1.0 kg/pair is to be interpreted by convention in the trade as including any heel loop, highback, ankle strap, toe strap and fittings supplied with the boot binding, but without any of the components of the ski or ride mode interface. A pair of mounting pucks as shown in FIG. 7E may weight as little as 150 gms. The toe pivot cradle depicted in FIG. 14 (122) weighs only 50 gms or less and is single piece machined aluminum. The weight of the rider's boots may vary, and by convention is also not included.

A "ski mode interface" is an assembly affixed to a splitboard, the interface having a toe pivot bracket or "cradle" for pivotably mounting a boot binding thereon. The ski mode interface is used in "ski mode", a noun indicating a boot binding system and interface in which splitboard ski members are configured to be used in the manner of skis: one per leg, by a fixed toe and elevatable heel.

A "ride mode interface" is an assembly affixed to a splitboard so that a rider can ride with legs spread and body generally sideways on the board. "Ride mode" when not used as an adjective, is a noun, indicating a boot binding system and interface in which a splitboard is configured to be ridden in the manner of a snowboard. Ride mode interfaces may comprise paired mounting pucks for each foot, such that one puck of each pair is affixed to one half of a splitboard having two separate halves, so that when the boot binding is engaged thereon, the halves of the splitboard are rigidly joined to each other. Splitboards operating on this principle were first described by Ueli Bettenman starting in about 1988, and include Pat. Doc. Nos. CH681509, CH684825, and German Gebrauchsmuster DE9108618 and EP0362782B1.

Torsional stiffness: in its simplest engineering analysis, torsional stiffness can be approximated by a form of Hooke's law relating torque to deformation:

$$T=K*\Delta\theta \quad \text{(Equation 1)}$$

where T is torque, K is a spring constant reflecting the stiffness, and $\Delta\theta$ (theta) is the angular deformation or displacement of the baseplate on its ride mode interface relative to the surface of the splitboard. A more complex model including elastic shear modulus, loss shear modulus, and dampening coefficients may also be formulated.

Considering a baseplate engaged on a ride mode interface, a preferred level of torsional stiffness of a representative article of the invention is in the range of 150 to 300 in-lb/degree when taken as rotation of the baseplate at a fulcrum point. A critical range for ride mode is found when torsional stiffness is brought to 180 to 280 in-lb/degree. A corresponding preferred level of torsional stiffness taken for the binding interface as a whole (i.e., with boot, heel loop, boot straps and highback) is in the range of about 50 to 150 in-lb/degree, most preferably in the range of 70-130 in-lb/degree. The composite stiffness of the boot and straps is typically less than the stiffness of the baseplate taken alone so as to permit greater ankle motion in ride mode and when touring.

"Torsional spring" refers to a plate-like or complex spring undergoing a torsion on a fulcrum. The capacity of the spring to resist a deforming force on the plate and to recover when the force is released is the torsional stiffness constant K of the spring. In some instances the spring includes a plate, a puck, a lever, and a fulcrum, where the lever may be another plate. Hence the spring constant for the spring is a composite of the elastic properties of the interacting elements. Spring constants can be isolated by attaching the binding to a splitboard in ride mode, placing a lever arm on the plate forming the top of the mechanical stack (on what would support the rider's boot sole) and measuring torque and deformation of the lever arm relative to the splitboard top surface. The stiffness constant is then derived from the a slope of a plot of deformation versus torque. This is demonstrated in FIGS. 24A and 24B.

"Foot roll": is a term of art used to denote bending of the legs and ankles used by an experienced board rider. The rider uses foot roll to shift the pressure or "bite" of the board on the underlying snow and to control the ride. Foot roll is tied to the "$\Delta\theta$" in the equation for torsional stiffness. Optimizing the stiffness factor K optimizes the control of the ride achieved with foot roll. Control of foot role is maximized in a critical range of mechanical coupling stiffness between baseplate and board.

"Mounting puck" is a term of art referring to a flanged mounting block used in pairs as a ride mode interface, the pucks of a pair having parallel flanges configured to grippingly conjoin and flangedly engage mating flanges of a boot binding underside channel, thus joining the two ski halves of a splitboard.

Material properties: refer to properties that vary from material to material, for example hardness, density, modulus of elasticity, tensile strength, wear properties, fatigue resistance properties, specific strength, and so forth. Material properties may be uniform from member to member, as in a monolithic article cut from a single block or an article folded from a single sheet, or may be graded or anisotropic. The material properties of aluminum, for example are different from the properties of a molded plastic, or fiber composites, or steel, for example. Substituting one material for another can result in a body having different material properties that may result in surprising behavior. For example, the mounting block assemblies may be formed of a plastic, a metal, or a combination thereof, each material having a distinct spring constant and a unique ride feel. Splitboard styles tend toward more aggressive line choices, more power edging, and abrupt maneuvering, necessitating optimized material choices. A torsional spring built into the boot binding systems of the invention has an engineered stiffness coefficient derived from material choice, shape, and interconnections.

As used here, the terms "plastic" and "molded plastic material" include any processable resin. Examples of suitable resins include, but are not limited to, nylons such as 6,6-polyamide, 6,12-polyamide, 4,6-polyamide, 12,12-polyamide, 6,12-polyamide, and polyamides containing aromatic monomers, cyclic olefins, polybutylene terephthalate, polyethylene terephthalate, polyethylene napthalate, polybutylene napthalate, aromatic polyesters, liquid crystal polymers, polycarbonate, polycyclohexane dimethylol terephthalate, co-polyetheresters, polyphenylene sulfide, polyacylics, polypropylene, polyethylene, polyacetals, polymethylpentene, polyetherimides, polysulfone, polyethersulfone, polyphenylene oxide, polystyrene, polyacrylonitrile, styrene copolymer, mixtures and graft copolymers of styrene and rubber, carbon fiber, polyaramid fiber, and glass reinforced or impact modified versions of such resins. Blends of these resins such as polyphenylene oxide and polyamide blends, and polycarbonate and polybutylene terephthalate may also be used in this invention. The resins may also contain plasticizers, and heat and light stabilizers. Materials include carbon fiber, Dupont Zytel (high grade nylon resin) and fiberglass. The amount of reinforcements or filler used may vary from about 1 to 70 weight percent based on the weight of the polymer and filler present. Composite constructs incorporating one or more inserts in an injection molded part are also anticipated as a means of improving strength of injection molded boot bindings around threaded fasteners and pins and other structures needed reinforcement, for example metal inserts or attachments forming the inside flanges of the girder lateral and medial rails. These composites can be formed in the injection molding process or can be assembled separately with a molded subassembly. Similarly, lightweight cores embedded within or cut out of plastic ribs can be used to decrease weight without sacrificing strength.

"In alternation" or "in turn" refers to interchanging the position of a boot binding system between a first interface and a second interface, and includes swapping the system between a ride mode interface and a ski tour interface, but may also include switching the system from one splitboard to another board having a compatible interface. Thus any combination of interfaces may be selected in turn because the engagement mechanism enables attachment to any of them.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," "toeward" is relative to the term "heelward," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can,'" and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

Unless the context requires otherwise, throughout the specification and claims that follow, the term "comprise" and variations thereof, such as, "comprises" and "comprising" are to be construed in an open, inclusive sense—that is as "including, but not limited to."

Exemplary Technical Features

This invention relates to boot bindings and interfaces for splitboarding in ride mode and ski mode. An objective is to achieve a boot binding having features of increased stiffness over prior art articles, decreased weight, and a lower boot sole elevation: in short, "stiffer, lighter and lower". Multiple features have been developed to meet this need.

A pedal or latch actuator feature is operative to reversibly attach a boot binding baseplate to a ride mode interface and the same pedal mechanism operates for instance to reversibly attach the boot binding baseplate to a toe cradle of a ski tour interface. Advantageously, the pedal mechanism reduces the number of moving parts to one, and eliminates the insertable locking or clevis pins of the prior art, which are easily lost. The pedal mechanism can be made of a single molded part and cannot be lost in normal use.

Preferred boot binding systems described herein include one or more of the following features: each member of a pair of boot bindings is provided with a baseplate for supporting the rider's boot, where the baseplate includes a modified π-girder and a hinged latch pedal at one end, a latch pedal having a detent disposed on the pedal that operates by interference to secure the baseplate ton one of two interfaces. In ride mode, the detent may serve to immobilize the baseplate on a pair of mounting pucks. In touring mode, the detent may operate to attach the baseplate so as to permit pivoting of the baseplate on a pair of toe pivot axle stubs, termed here "pintle pins", or on an axle mounted through toe pivot ears.

To alternate between the two configurations, the pedal detent is raised and disengaged from any contacting members so that the baseplate may be reversibly detached or switched between ski mode configuration and ride mode configuration. Typically this involves a characteristic horizontal motion to dismount the binding rather than the conventional lift out dismount. The rider locks each boot binding in ride mode or touring mode by depressing the latch pedal so as to contactingly engage the detent member with the chosen interface. In touring mode, the latch pedal engages pintle pins of jaw members when pivotably inserted into a pivot bracket or cradle. In ride mode, the latch pedal engages mounting pucks which are affixed to the splitboard so that the baseplate is immobilized.

Splitboards are characterized by two interfaces on which the boot binding may be mounted, a ride mode interface and a ski mode interface. In FIGS. 1 through 11, binding mounting system will be described in the context of the ride mode interface. In FIGS. 12 through 21, the ski mode interface will be described. While broken out for purposes of explanation, the binding system interacts with both interfaces and is designed as a dual purpose mechanism as shown in combination in FIG. 8 and FIG. 21. In the remaining figures, a general approach to the objective of stiffer, lower and lighter will be presented, followed by data supporting the uniqueness of the binding and interface system and its advantages in achieving the objectives of the invention.

FIG. 1 is a perspective view of an exemplary boot binding system of the invention as configured for ride mode. In this mode, the boot binding is affixed to a splitboard using two mounting pucks 102 visible through the cutouts 101*b* of the baseplate 101. The board itself is not shown, but the combination is demonstrated in FIG. 8, where ride mode is illustrated in a context of use. Also shown is a latch pedal mechanism 103 and pintle pins 111*a* as will be described below. Some boot binding systems are supplied with one or more climbing bars. The boot binding system may include conventional accessory features of a boot binding system, including toe and ankle straps and highback, for example. Toe and ankle straps may include ratchet buckles as shown. Optionally, any combination of accessory features may be supplied as are compatible with any of the boot binding baseplates, latch pedals, and mounting interfaces of the invention.

Figure 2:
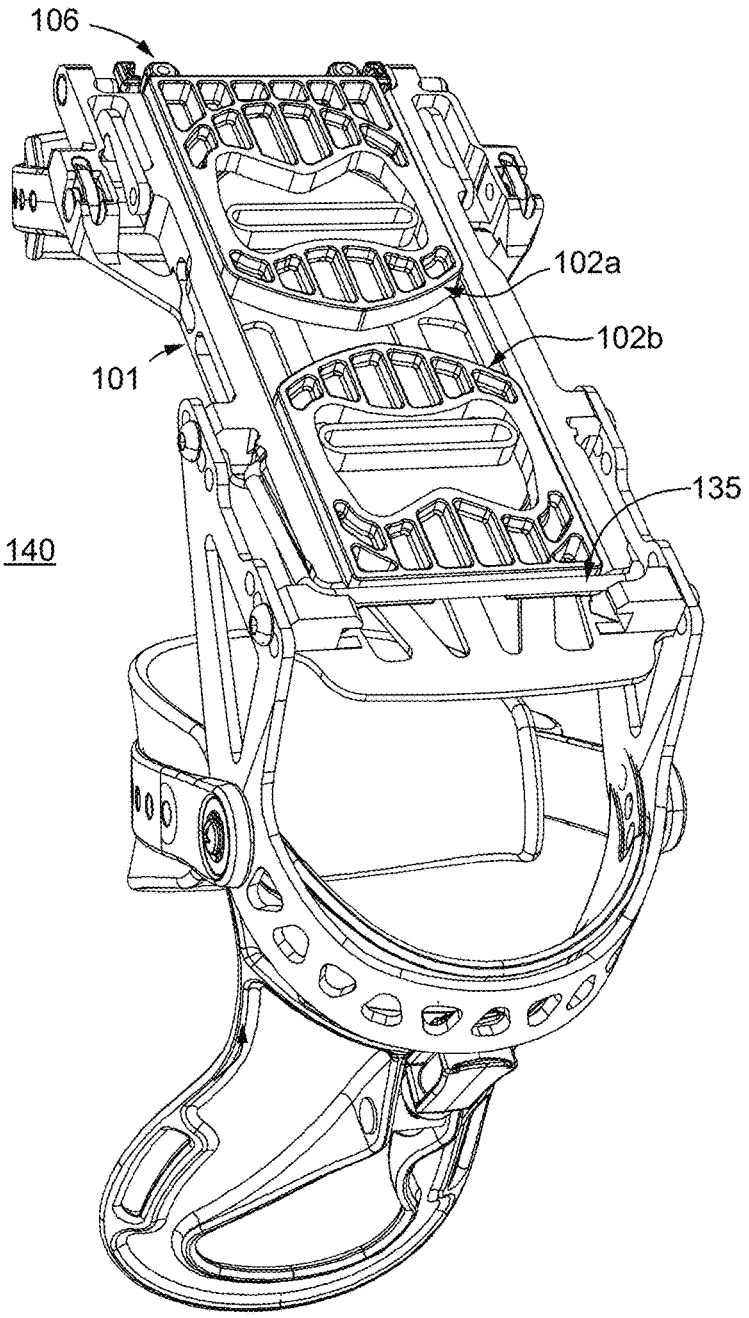
FIG. 2 is a perspective view of the underside of an exemplary boot binding system with captive mounting pucks.
Figure 8:
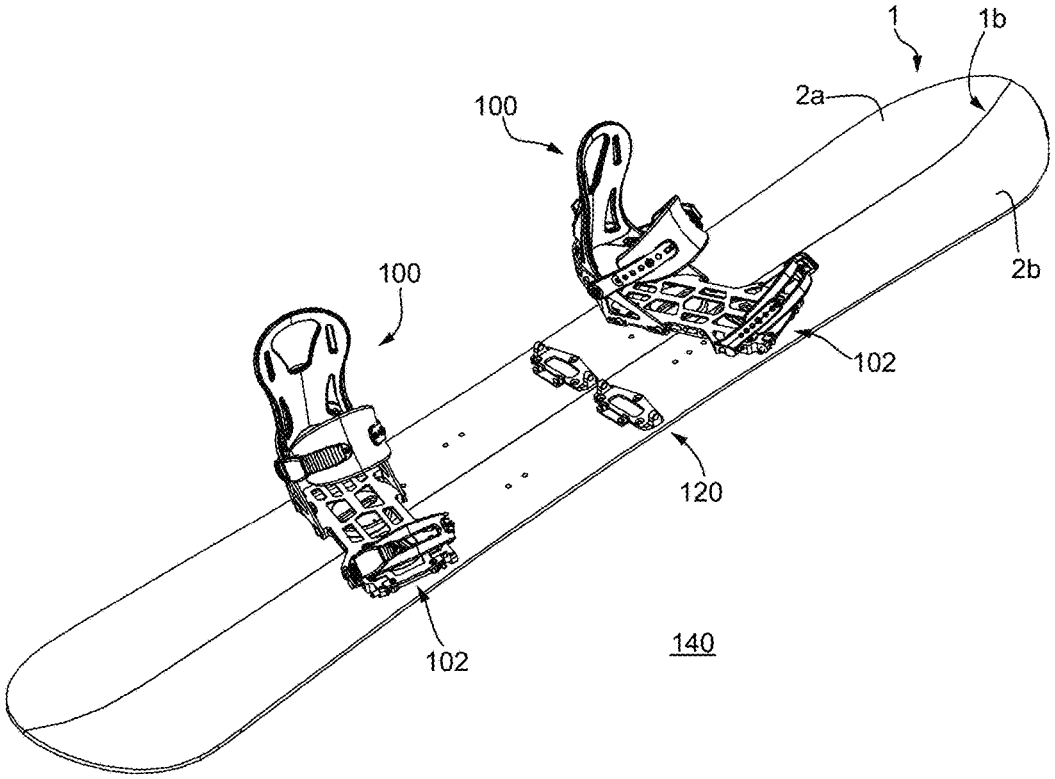
FIG. 8 shows a combination of representative boot bindings in ride mode on a splitboard.

FIG. 2 is a perspective view of the underside of a ride mode boot binding configuration with boot binding baseplate 101 and mounting pucks 102*a*,102*b*. When mounted on a first ride mode interface (i.e., mounting pucks 102*a*, 102*b* as fastened on a board), the combination is termed ride mode configuration 140 (FIG. 8). The mounting pucks are locked in place in a flanged channel between a detent 106 mounted on a novel latch pedal and a climbing bar 135 at the heel end as will be described below. Mounting pucks are known in the art and are described more fully in U.S. Pat. No. 5,984,324 to Wariokois, U.S. Pat. Nos. 7,823,905, 8,225,109, 9,022,412 and 9,452,344 to Ritter, all of which are incorporated in full herein by reference. The pucks shown here have been reduced in mass and are more fully adjustable. The latching system presented here eliminates the need for retaining pins and cables or tethers to capture the hardware, also saving weight. Advantageously, the system operates with dual mode capability (ride mode and ski mode), having a single moving component (and no disassembly required) to switch from one mode to the other. Surprisingly, the rider finds one hand free to hold the splitboard when moving the binding assembly from one interface type to the other and can lock the boot binding system onto an interface with the other hand, or even just the toe or heel of a boot. The single climbing bar 135, shown here as a best mode, also reduces weight. Also shown are optional conventional boot binding elements including a toe strap, ankle strap, heel loop and highback.

Figure 3:
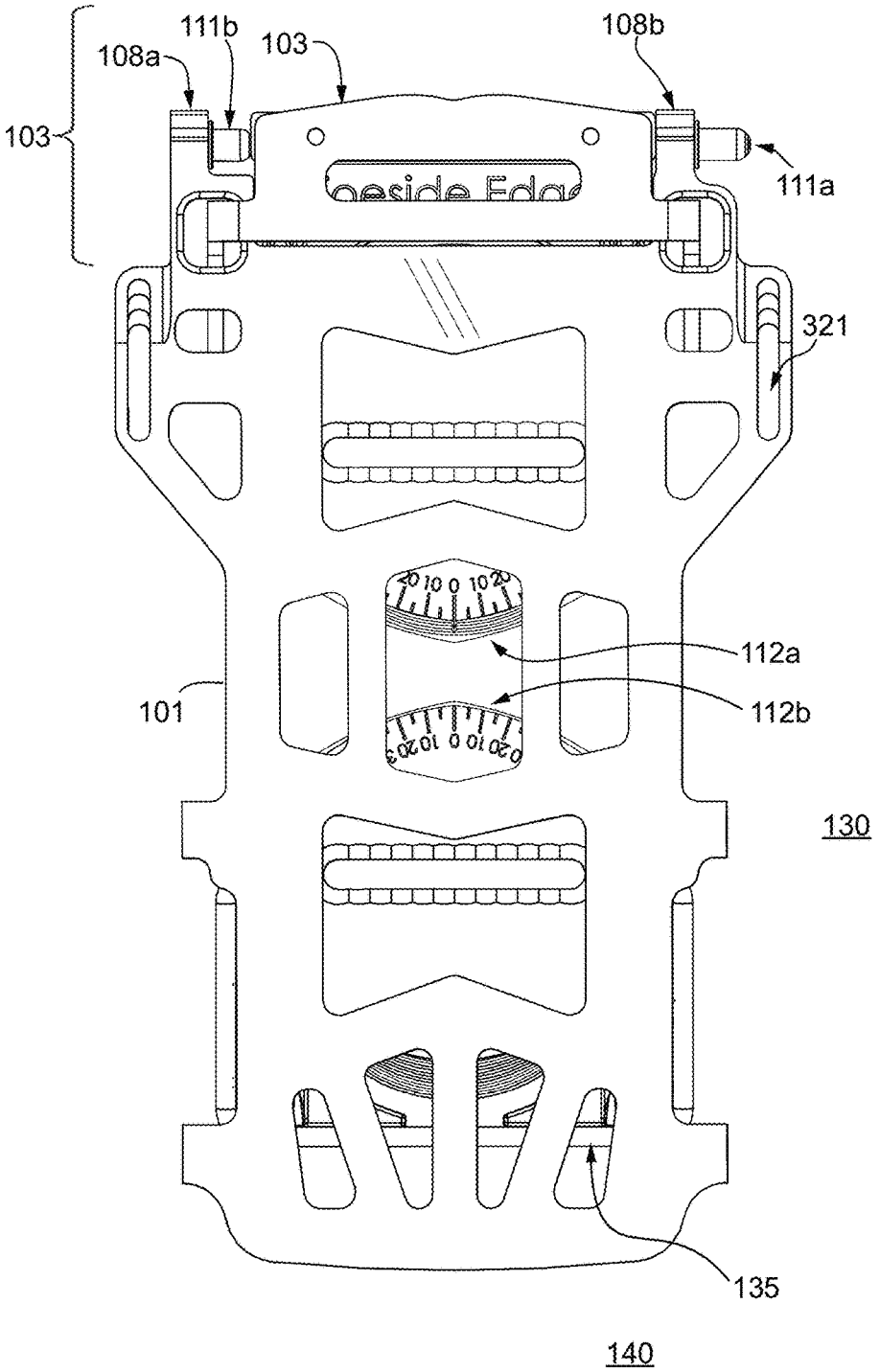
FIG. 3 is a plan view of a baseplate from the top with ride mode interface. The foot latch pedal mechanism is in a closed, locked position.

FIG. 3 is a plan view of a baseplate with ride mode interface. Ride mode interface with baseplate/toe pedal assembly 130 is viewed from the top. The foot latch pedal assembly 103 is in a closed, horizontal position relative to the baseplate so as to lock the baseplate onto the mounting pucks visible through fenestrations in the foot support plate of the π-girder. Baseplate 101 includes anterior jaw members (108*a*,108*b*) and pintle pins 111*a*,111*b*. In combination, the baseplate/latch pedal combination, when mounted on the ride mode interface (pucks, 112*a*,112*b*), forms the ride mode configuration 140.

Figure 4A:
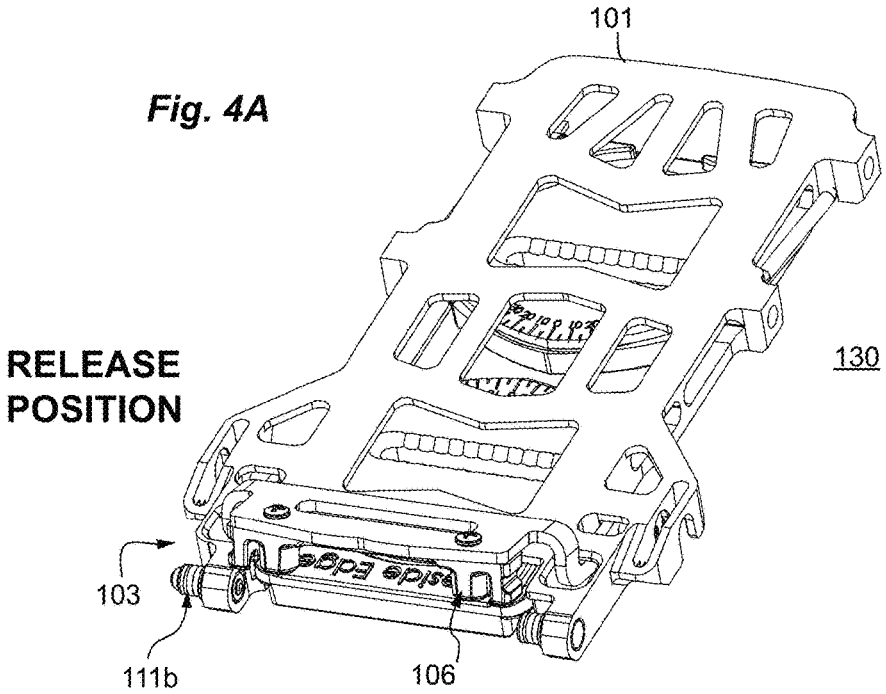
FIGS. 4A and 4B are perspective views of the baseplate and foot latch pedal assembly showing the operation of the mechanism in ride mode.
Figure 4B:
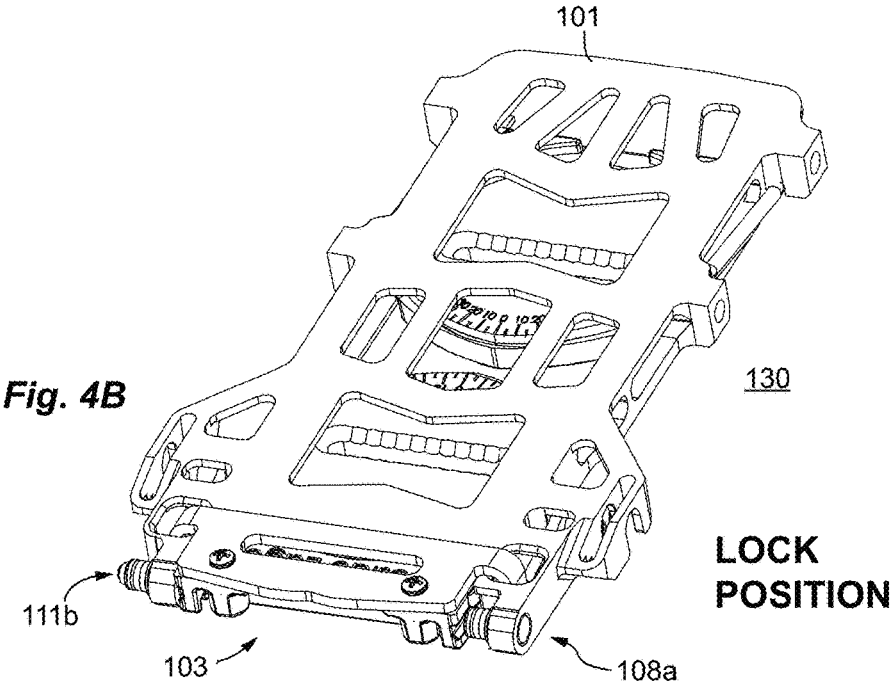

FIGS. 4A and 4B are perspective views of the baseplate/latch pedal assembly showing the operation of the mechanism in ride mode. In FIG. 4B, foot latch pedal assembly 103 is depressed so as to lock the baseplate toewise onto a mounting interface such as described above. The alternate positions of detent 106 are shown to make interference contact with one of the pintle pins 111*b*.

Figure 5:
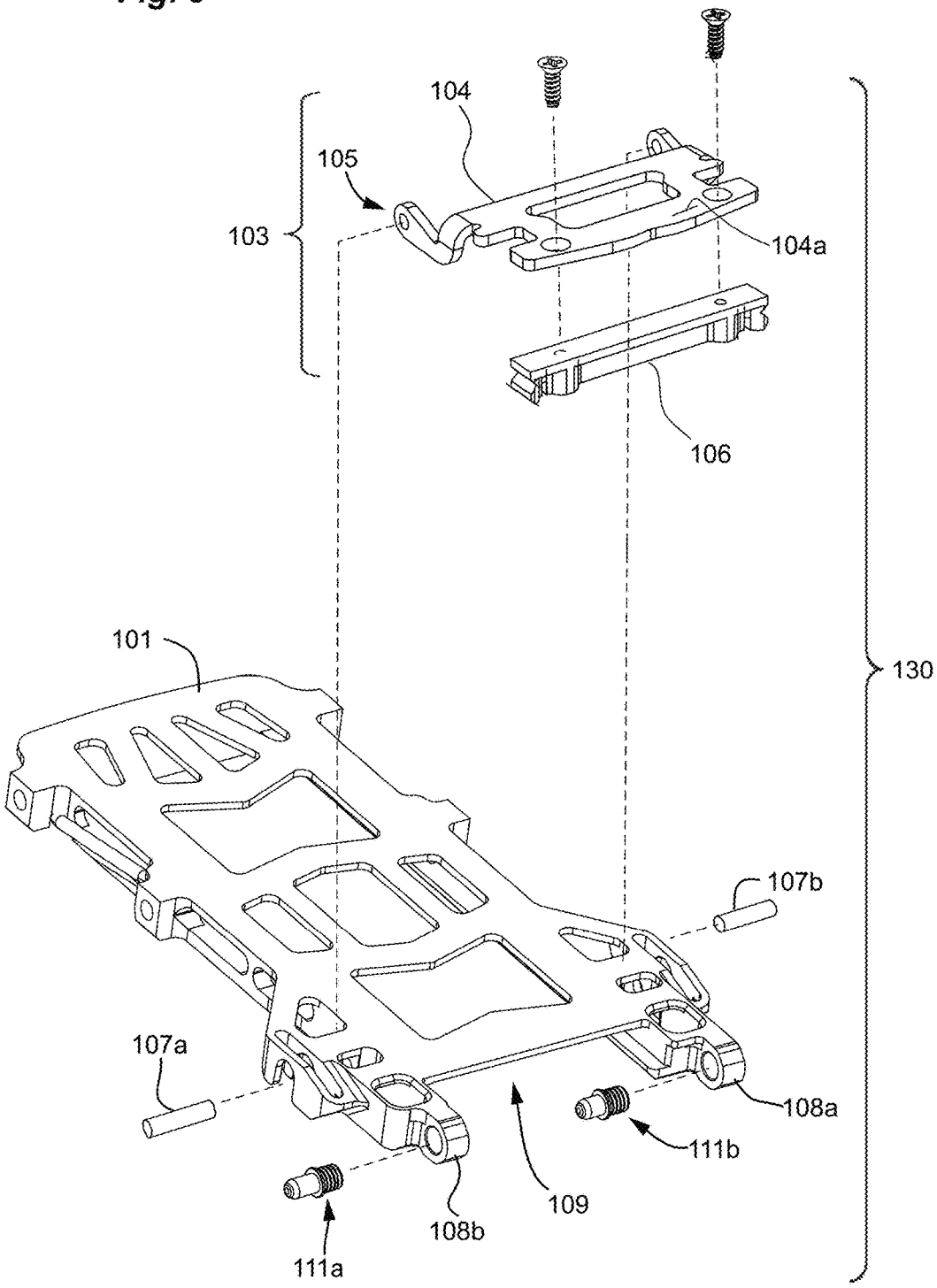
FIG. 5 is an exploded view of an exemplary boot binding baseplate with foot latch pedal mechanism.
Figure 13:
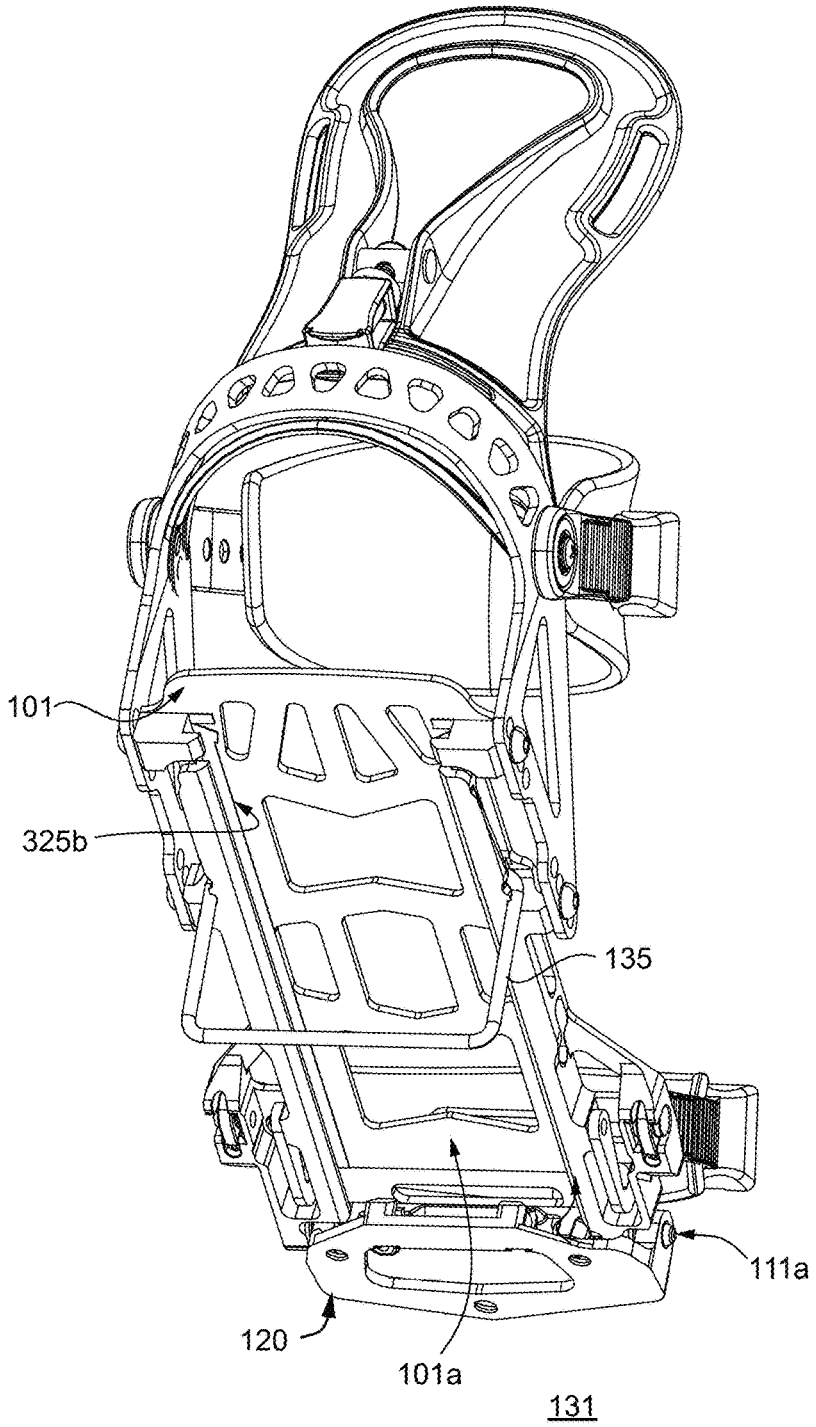
FIG. 13 is a perspective view of the underside of a boot binding with ski mode interface and with climbing bar deployed.

FIG. 5 is an exploded view of a baseplate/latch pedal assembly with pucks. The latch pedal mechanism 103 includes a foot pedal plate 104 with hinge arms 105 and a detent member 106. Detent members having dimensions and stiffness suitable for interference capture of the mounting pucks in a flanged channel under the baseplate are contemplated without limitation. The foot pedal pivots on hinge pins 107*a* and 107*b*. The foot pedal is provided with a pedal top face 104*a* for engaging and supporting a rider's foot. The detent also serves to lock pintle pins 111*a*,111*b* to a ski mode interface as will be described below (FIG. 13). A mounting box slot 109 for the pedal plate assembly is formed by inside edges of jaw members 108*a*,108*b* and a cutout from the baseplate. The foot pedal top face 104*a* and baseplate 101 are generally parallel and horizontal when the foot latch pedal is in a locked position, as shown in FIG. 4B and abutting the ride mode interface. The assembly 110 is defined by baseplate 101 with box-like mounting slot 109, toe pintle pins 111*a* and 111*b*, and latch pedal mechanism 103 on hinge pins 107*a* and 107*b*, and reversibly engages either a ski tour interface or a ride mode interface when in use by a rider. Duality of function is a characteristic of the latch pedal systems of the invention.

Figure 6:
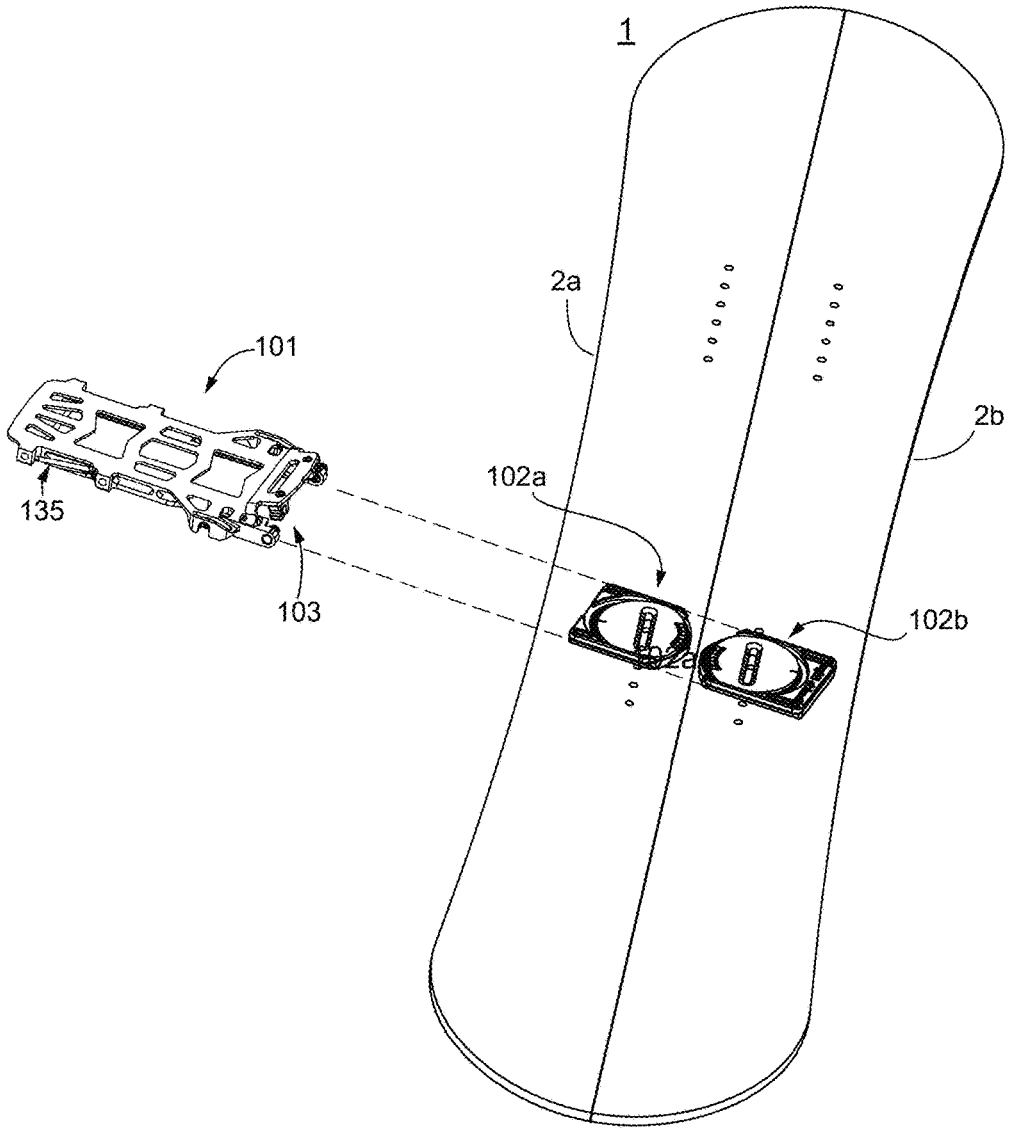
FIG. 6 is a schematic illustrating the process of attaching a baseplate to a pair of mounting pucks on the ski halves of a splitboard.

FIG. 6 is a schematic illustrating the process of reversibly attaching a baseplate assembly 110 to a pair of mounting pucks on the ski halves 2*a*,2*b* of a splitboard 1. The foot latch pedal is in the open position, and when the pucks 102*a*,102*b* are fully engaged on mating flanges on the underside of the baseplate, the foot latch pedal is depressed to lock the baseplate onto the pucks. The duplex arrow indicates that the boot binding may be engaged or disengaged by sliding the baseplate on or off the mounting pucks. Mating flanges on the pucks and the underside of the baseplate ensure a tight fit that rigidly joins together the splitboard ski halves.

Serendipitously, the climbing wire 135 serves to capture the heel end of the mounting block interface and the toe end is captured by depressing pivot pedal assembly 103. When locked in place, the baseplate assembly is fully immobilized on the ride mode interface.

Figure 7A:
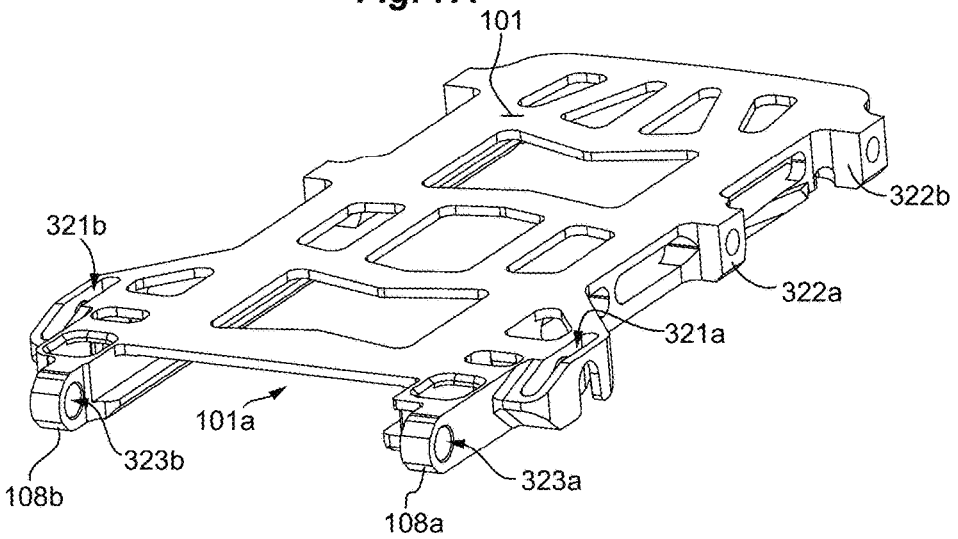
FIGS. 7A and 7B are views of a representative baseplate with modified pi-girder construction with underside channel.
Figure 25A:
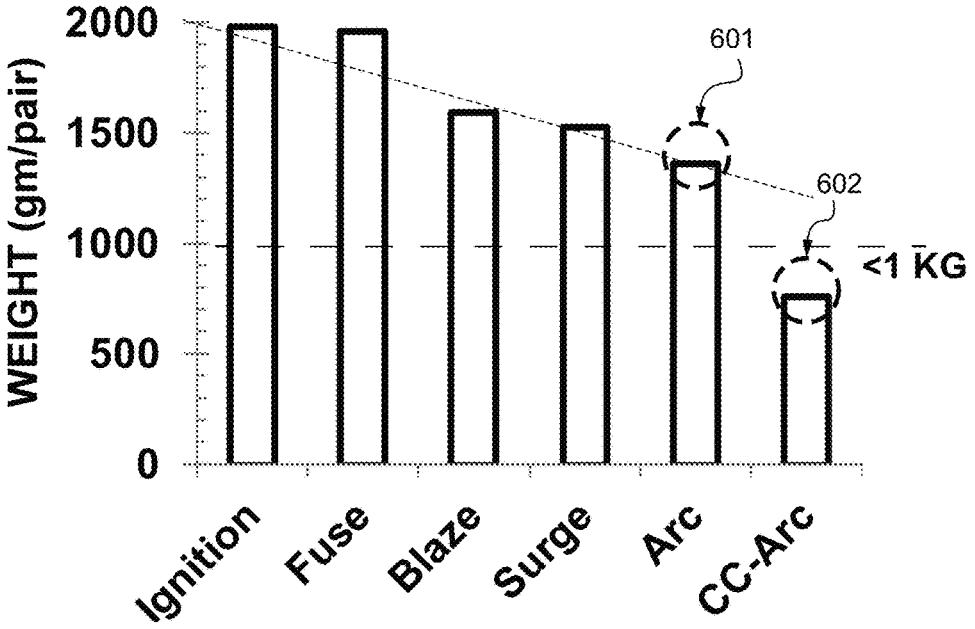
FIG. 25A is a plot of the weights of several boot bindings having one or more features of the inventive bindings.

FIG. 7A is a view of a superior surface of baseplate 101, drawn here to illustrate the girder construction. In this application, the π-girder is found to have a high degree of stiffness with limited weight when made by CNC milling from single block aluminum alloy. Like parallel I-beams, π-girders are stiff and resist flexing. Aluminum has a specific strength of about 220 kN-m/kg, very comparable to the more expensive titanium, which has a specific strength of about 260 kN-m/kg, and a similar elastic modulus. Weight reduction without loss of strength has been very successful—as shown in FIG. 25A. The lateral and medial webs of the girder are modified anteriorly with jaw brackets 108*a*, 108*b* to support coaxial pivot holes 323*a*, 323*b* for receiving pintle pins 111*a*,111*b* (not shown). The webs are also modified with lateral wings for receiving a toe strap slot 321*a*, 321*b* and pedal hinge as shown in FIG. 5. The slot also aids in assembling the foot pedal plate hinge. Two posts 322*a*, 322*b* for fastening a heel loop are formed on a posterior aspect of the webs. The girder has a widest dimension at the forefoot where the toe strap is mounted and narrows toward the heel. The girder is generally symmetrical on its lateral and medial aspects, but is not limited thereto, so as to have a left and right of a pair. The top plate may rest directly on the top plate, reducing weight.

Figure 7B:
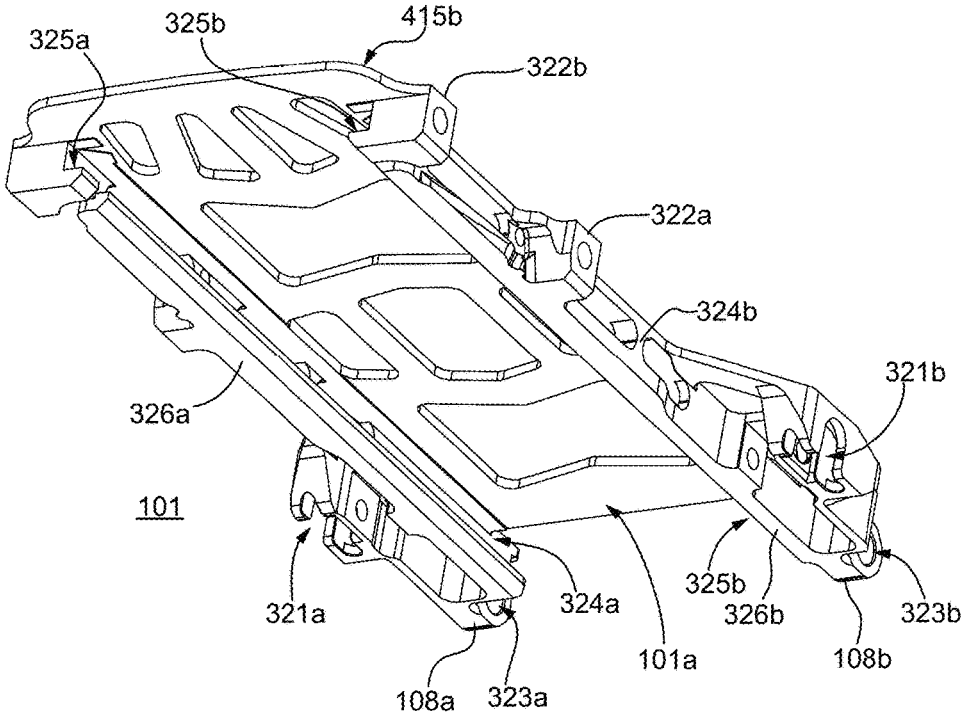
Figure 7C:
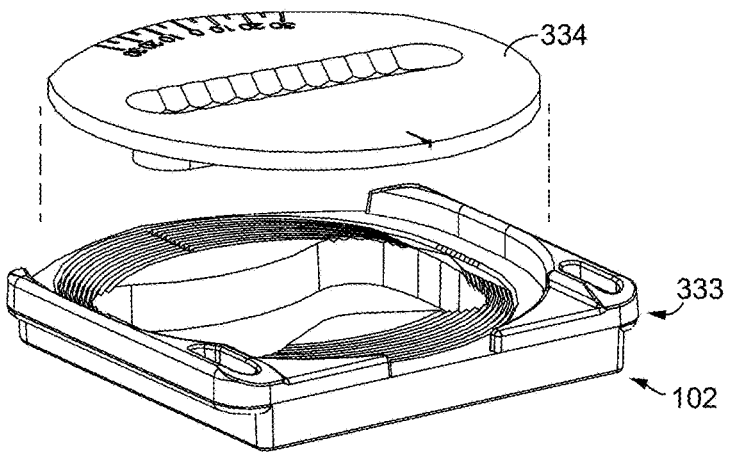
FIGS. 7C, 7D and 7E are detail views of an exemplary mounting puck as used in the ride mode interface.

FIG. 7B is a perspective view of the inferior surface of baseplate girder 101. Lateral and medial web members are machined from a solid piece that also forms the top plate of the girder and the inside flanges, and are shaped to provide attachment sites for elements used to strap the boot to the baseplate top surface. Between the girder webs 324*a*,324*b*, an open underside channel 101*a* is formed to receive mounting pucks (FIG. 7C, 102). The mounting pucks are supplied with parallel flanges 333 which flangedly conjoin the mating internal flanges 325*a*,325*b* of the bottom plate 326*a*,326*b*. The underside flanges extend from toe to heel; most of the bottom plate has been removed to reduce weight, but the medial and lateral "rails" of the bottom plate are used as described below to improve foot roll responsiveness. When inserted into toe pivot holes 323*a*,323*b* in the jaw brackets 108*a*,108*b*, the pintle pins (not shown) lock the mounting pucks in the underside channel so as to secure the boot bindings in ride mode.

FIG. 7C shows a composite puck having a retainer plate 334 that is generally made of aluminum and a puck body 102 that is made of a fiber composite plastic such as nylon or polycarbonate. The relative torsional spring constants of each spring element (i.e., the plate and the body) are adjusted to achieve a desired torsional stiffness for the assembly. Fasteners are not shown.

Figure 7D:
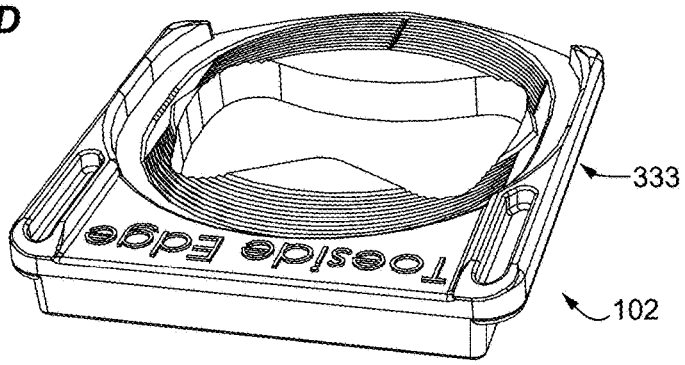
Figure 7E:
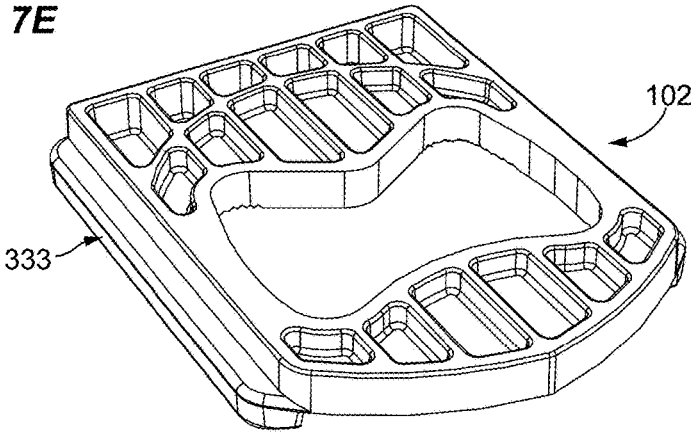

FIGS. 7D and 7E are detail views of an exemplary mounting puck 102 as used in the ride mode interface. The pucks are molded pieces in this embodiment and are reduced in mass, but retain a spring constant that improves the feel of control of the board. Adjustments are up to the rider, but a system for increased precision and a full range of adjustment has been recently released (see U.S. Pat. No. 9,452,344 to Ritter, which is co-owned and is incorporated in full by reference. Also shown are the parallel flanges formed on each side of the puck body. These are mated with the inside flanges of the medial and lateral rails of the baseplate in ride mode and result in a spring combination having its own stiffness and spring constant.

FIG. 8 shows a combination 140 of representative boot bindings in ride mode on a splitboard 1. In ride mode configuration, two boot bindings 100 are docked generally crosswise on the board using the mounting puck interface. Thus the inventive boot binding systems of the invention may also be combined with a splitboard and sold as combinations 140 therewith, adding economic value beyond the mere ratio of the component price. Shown also is a ski tour interface 120. The ski tour and ride mode interfaces may be sold as a kit or sold separately and are generally supplied with fasteners (not shown).

Figure 9:
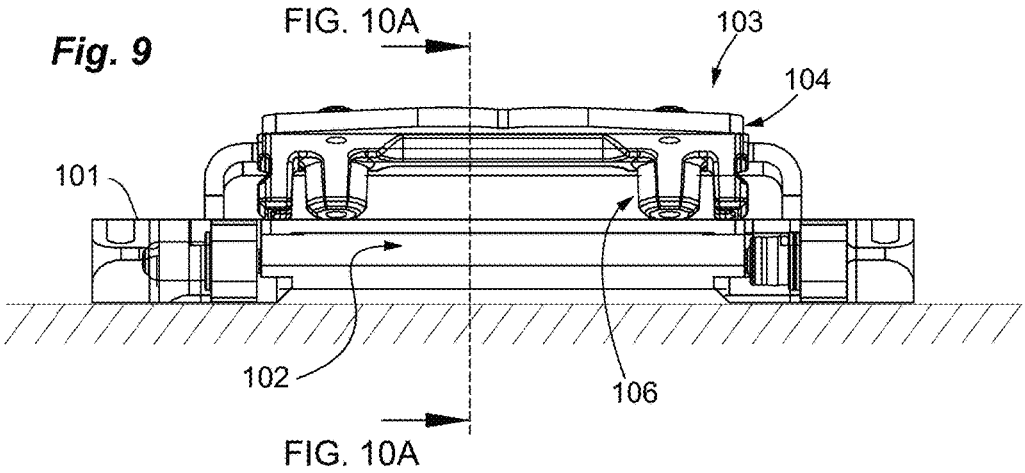
FIG. 9 is a frontal toe end view of a latch pedal in an open position on a baseplate.

FIG. 9 is a frontal toe end view of a toe pedal latch in an open position on a baseplate 101. FIG. 9 shows the raised position of the latch pedal in RELEASE POSITION. A mounting puck 102, foot pedal plate 104 and detent 106 are visible under the baseplate.

Figure 10A:
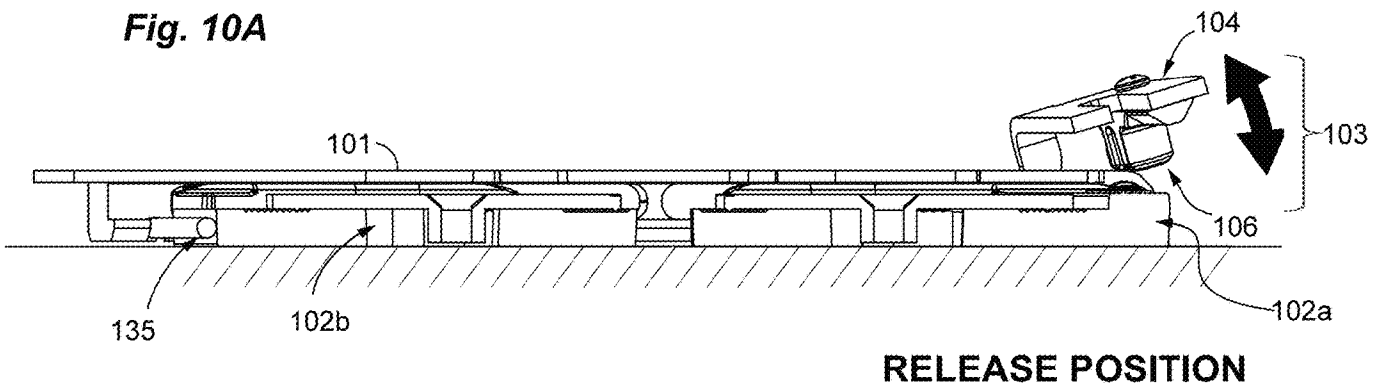
FIGS. 10A and 10B are long axis section views showing the operation of the foot latch pedal on a ride mode interface.
Figure 10B:
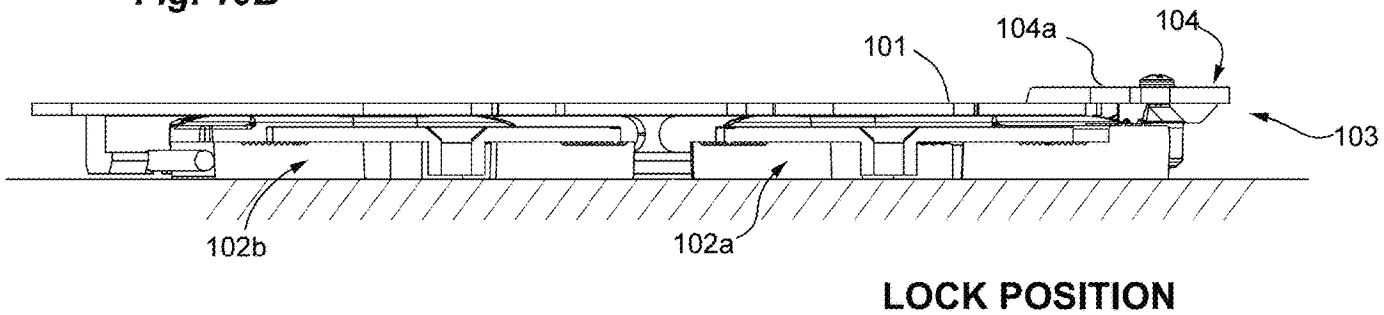

FIG. 10A is a long axis section view showing the operation of the foot latch pedal in RELEASE POSITION on a ride mode interface. FIG. 10B shows a corresponding section through a snap latch in LOCK POSITION. Mounting pucks 102*a*,102*b*, foot latch pedal assembly 103, detent 106, and climbing bar 135 are visible in the mounting box slot (FIG. 5, 109) in this sectional view. The pedal plate surface 104*a* is shown to be generally horizontal when down, and is generally aligned with the baseplate. Paired hinge arms or other pivot means allow the foot pedal plate to pivot from a first, raised position, angled up from the baseplate, to a second, depressed position where the foot pedal plate is essentially flat with the baseplate. When the foot latch pedal mechanism is up and open, the bindings may be removed from their attachment and transitioned for either ride mode or ski mode (FIGS. 18A, 18B), or from one board to another. When the rider's finger or foot is then used to depress the foot latch pedal into its lock position, the boot binding is locked to the selected interface.

Figure 11A:
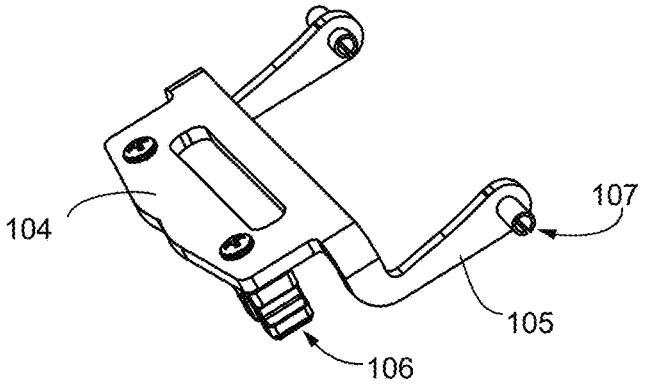
FIGS. 11A and 11B are views of a latch pedal with pivot plate and hinge arms.
Figure 11B:
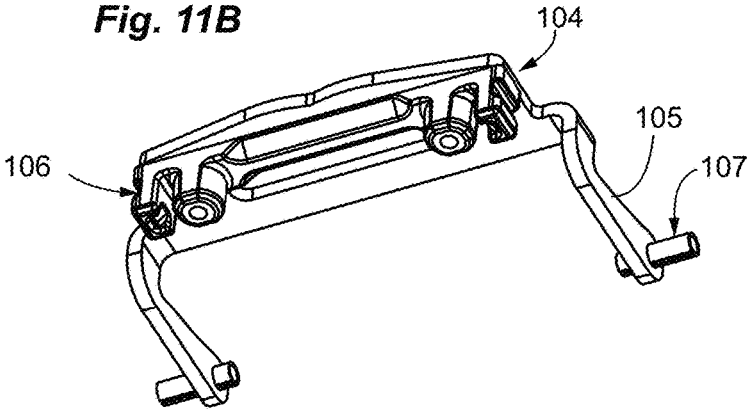

FIGS. 11A and 11B are views of a foot latch pedal plate with hinge arms. Hinge arms 105 connect the pedal plate 104 to hinge pins 107 that insert into the baseplate at the toe strap slot 321. Detent member 106 is dependent from the pedal and is shaped to compress itself between a toe pivot cradle jaw member and a pintle pin, ensuring an interference fit.

Figure 12:
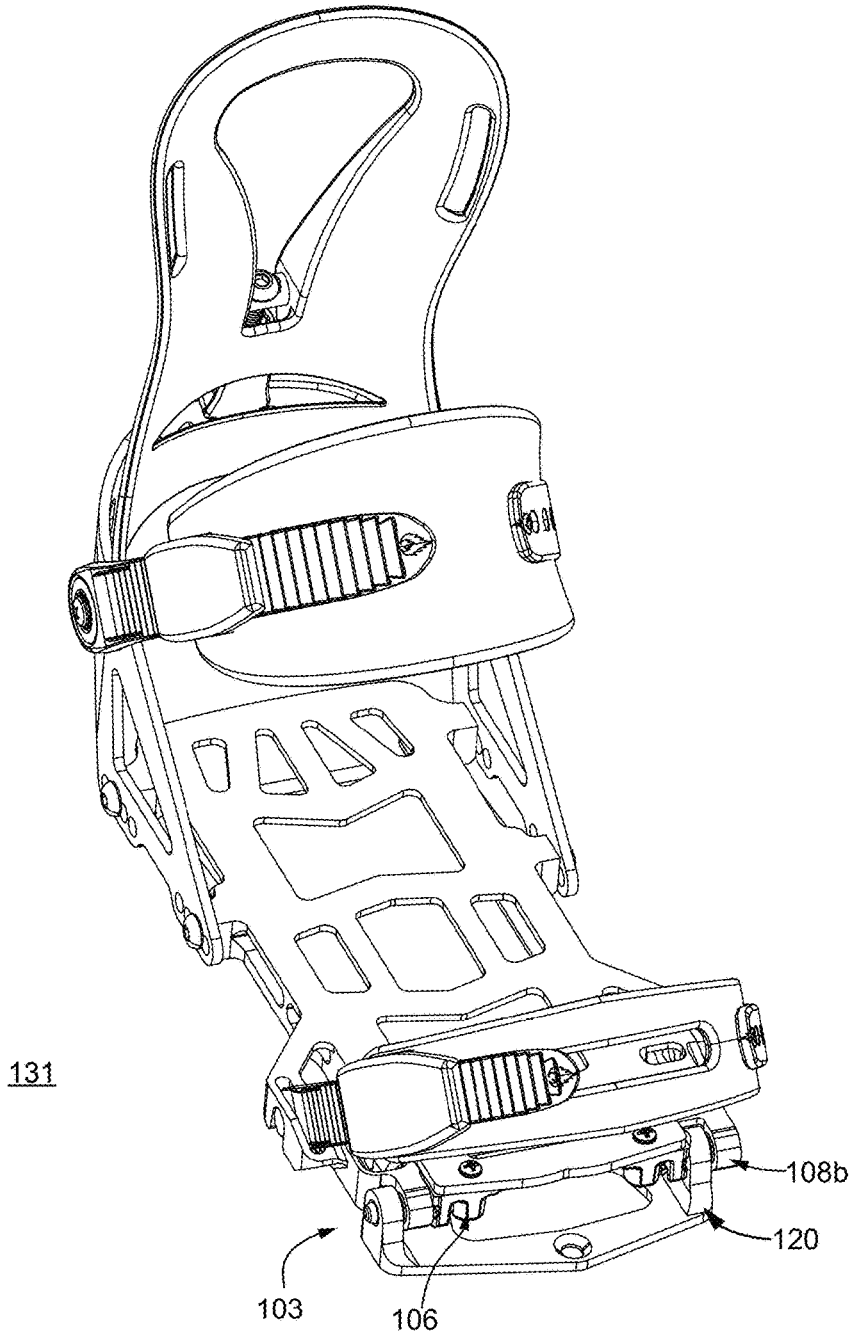
FIG. 12 is a perspective view of an exemplary boot binding as configured for ski tour mode.

Turning to the ski mode interface, FIG. 12 is a perspective view of an exemplary boot binding as mounted so to pivot at the toe on a toe pivot cradle 120 configured to engage pintle pins (FIG. 14, 111*a*,111*b*) and jaw members 108 of the baseplate assembly. The ski tour interface (i.e., toe pivot cradles 120) is fastened to the splitboard ski halves, generally in a center position lengthwise, one per ski member. The boot binding baseplate system in ski mode configuration 131 is pivotable at the toe, and attaches to a splitboard ski member through a toe pivot "cradle" or bracket 120. As visible here, latch pedal mechanism 103 is locked onto the ski tour interface by detent member 106. The detent 106 is wedged between the pintle pins 111 so that the baseplate can pivot but cannot disengage. When the boot binding is engaged on the toe pivot cradles, the combination is termed a ski mode configuration (131).

FIG. 13 is a perspective view of the underside of a boot binding with ski mode interface and with climbing bar 135 deployed. A three point system of fasteners is used to affix the toe pivot bracket 120 to a top surface of a splitboard ski member. The underside of the baseplate 101 is generally characterized as having an underside channel 101*a* disposed between lateral rails, the lateral rails with inside mating flanges 325*b* for gripping the corresponding parallel flanges of the ride mode interface as described above. Climbing bar 135 is shown in a deployed state. It is designed to be stowed in a recess, and also (when stowed) serves as a heel stop to capture the mounting pucks in ride mode. Thus like all features of the binding system, it is bifunctional.

Figure 14:
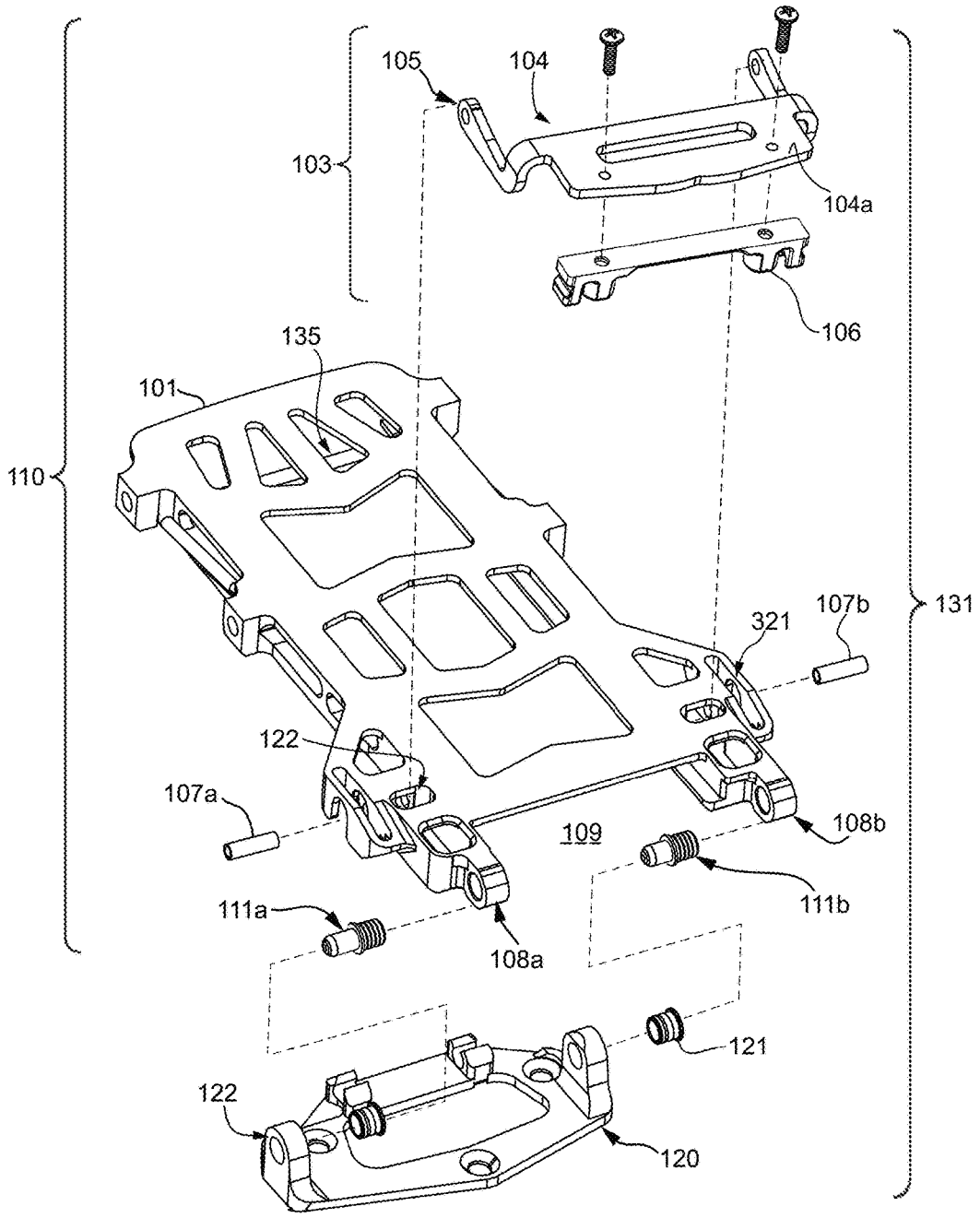
FIG. 14 is an exploded view of a boot binding baseplate with foot latch pedal assembly and toe pivot cradle.

FIG. 14 is an exploded view of a boot binding baseplate/latch pedal combination and ski mode interface. The baseplate/latch pedal assembly 110 was described earlier (FIG. 5). Foot pedal plate upper face 104*a* engages and supports the rider's boot. The foot pedal plate is hinged and pivots on hinge pins 107*a* and 107*b* as shown by dashed lines. Mounting box slot 109 for the pedal plate assembly is defined between anteriorly extending jaw formed by jaw members 108*a* and 108*b*, which receive toe pivot pintle pins 111*a* and 111*b*. The toe pivot pintle pins are designed to be inserted into holes in the toe pivot ears 122, which are shown here with bushings 121. The pintle pins are inserted as shown by dashed lines with an ipsilateral motion (from one side) into mating pivot holes in of the toe pivot cradle 120. When the detent member is lowered into the locking position between the the toe pintle pins, pins 111*a* and 111*b* cannot be disengaged from the anterior jaw members 108*a*, 108*b*, but the complete assembly 131 is free to pivot up and down at the heel, permitting "free heel" skiing and touring. Slot 321 is used to attach a toe strap and for assembly of the hinge pins 107*a*,107*b*.

Figure 15:
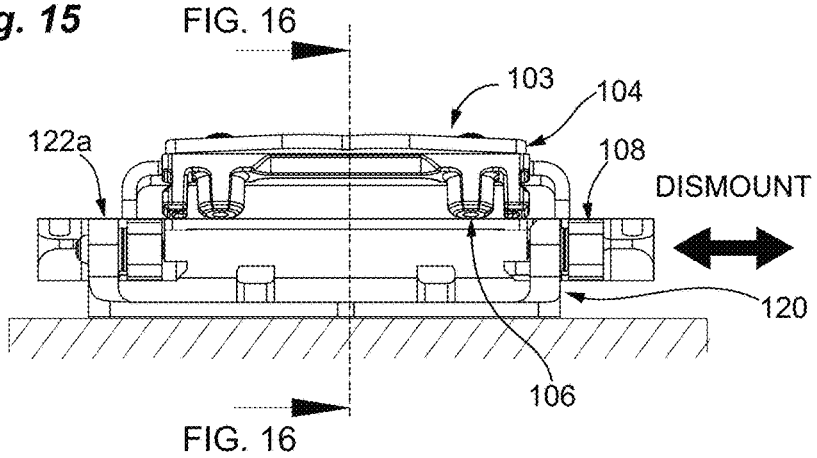
FIG. 15 is a frontal view of the toe end of a baseplate with a foot latch pedal in an open position on a ski mode interface.

FIG. 15 is a frontal view of the toe end of a baseplate with latch pedal mechanism 103 and toe pivot bracket or cradle 120 of a ski mode interface. The hinge arm and pedal plate are dimensioned so that detent member (FIG. 18A, 106) drops between toe pivot ears 122 of the toe pivot cradle 120 to block lateral disengaging movement of the baseplate when the pedal plate is pushed down. Here the toe pedal is in the open position. Pintle pins (FIG. 14, 111*a*,111*b*) are mounted ipsilaterally on anterior jaw members 108 of the baseplate and insert with a coordinated lateral motion into the corresponding pivot holes in toe pivot ears 122. The detent member 106 is flared at both ends to form a rigid wedge when abutted in the toe pivot cradle in the LOCK POSITION. When the toe pedal is raised, the baseplate is disengaged from the toe pivot ears by a lateral motion (bold arrow, DISMOUNT).

FIG. 16 is section view drawn to expose the operation of the detent member or element 106 on the ski mode interface. The section plane is not chosen to expose the hinge arm (105) and hinge pins (107, not shown) of the foot latch pedal mechanism 103 because the arms are in the toe strap slot (FIG. 3, 321), not in the underside channel 101*a* that is exposed here facing the inside wall of the girder web 325*a*. More clearly exposed in this view is the interaction of the detent blocks 106 with a toe pivot pintle pin 111 in toe pivot ear 122 of the toe pivot bracket or cradle (ski tour interface, 120). Detent member 106 is mounted inferiorly on foot pedal plate 104*a* and locks over the pintle pin head in ski mode.

Figure 17:
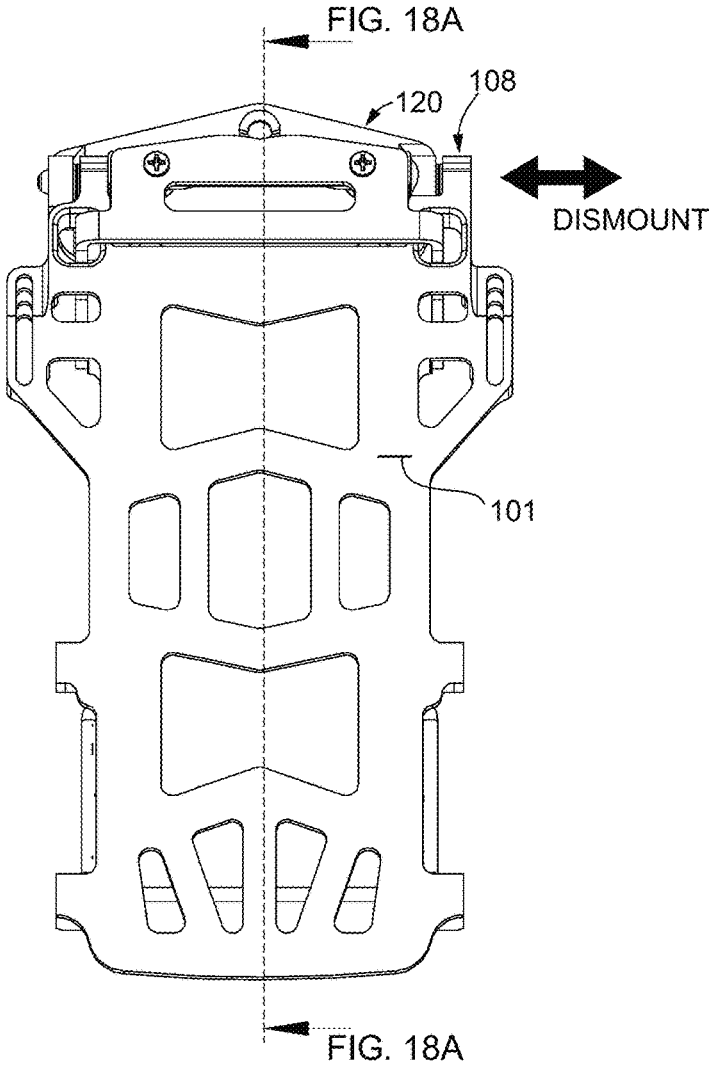
FIG. 17 shows in plan view a section plane through a baseplate with ski mode interface.

FIG. 17 shows in plan view a section plane through the top surface of baseplate 101, here shown coupled to ski mode interface 120. Because the pivot axle stubs are disposed ipsilaterally on the jaw members, the coupling appears asymmetrical, but advantageously eliminates a pivot pin and allows the rider to dismount the baseplate from the interface with a short sideways motion (bold arrow).

FIGS. 18A and 18B are section views showing the pivot operation of the foot latch pedal in ski mode. Pedal plate 104 opens and closes as shown (bold arrows), forcing the detent member 106 in and out of the ski tour interface 120, where impingement prevents disengagement of the baseplate from the toe pivot pintle pins. The ski tour interface is shown affixed to a splitboard upper face. FIG. 18A shows the raised position of the latch pedal in RELEASE POSITION; FIG.

18B shows the depressed position of the latch pedal in its LOCK POSITION. In FIG. 18B the detent 106 obstructs the view of the head of the pintle pin (111).

Figure 19A:
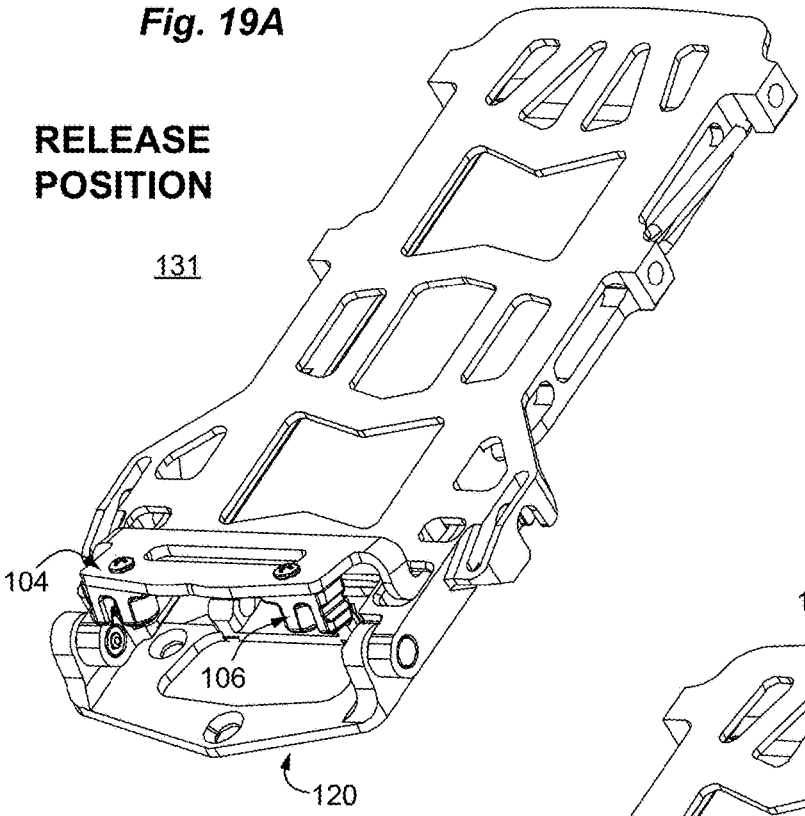
FIGS. 19A and 19B are perspective views showing the operation of a toe pivot assembly in ski tour mode.
Figure 19B:
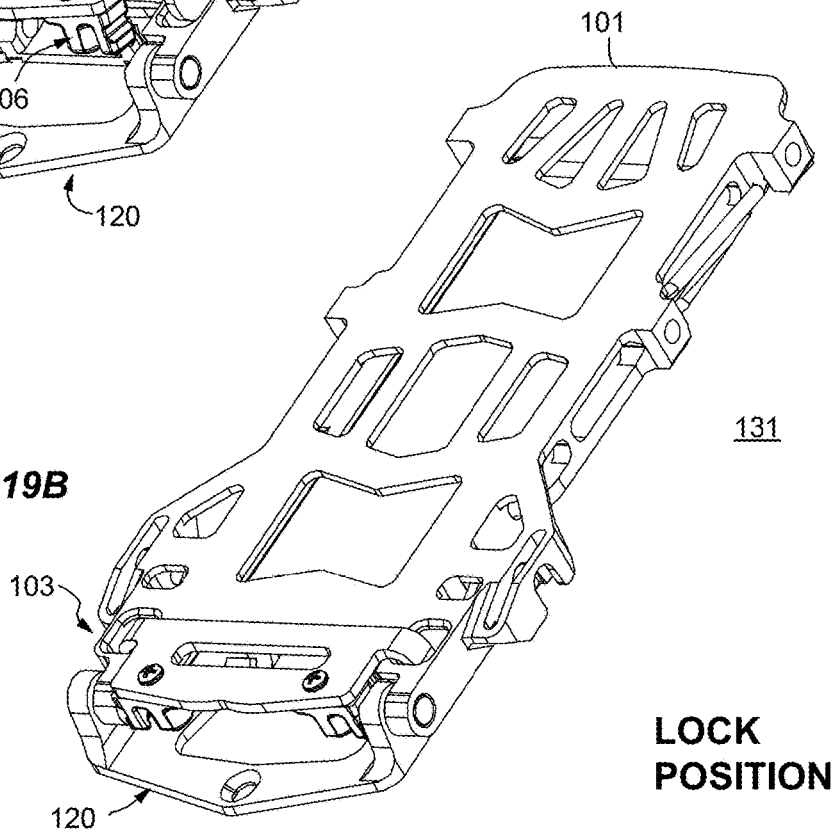
Figure 20A:
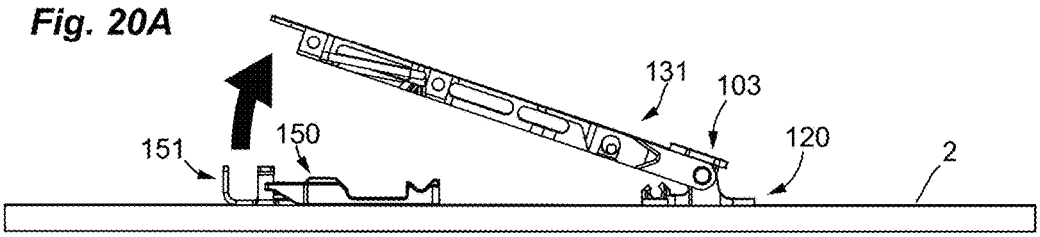
FIGS. 20A, 20B, 20C and 20D are elevation views demonstrating the operation of a baseplate/pivot pedal combination in free heel mode and with deployment of a climbing wire.
Figure 20B:
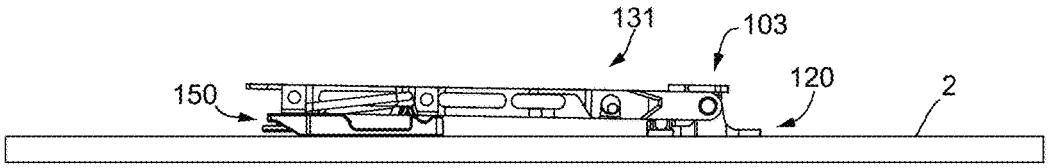
Figure 20C:
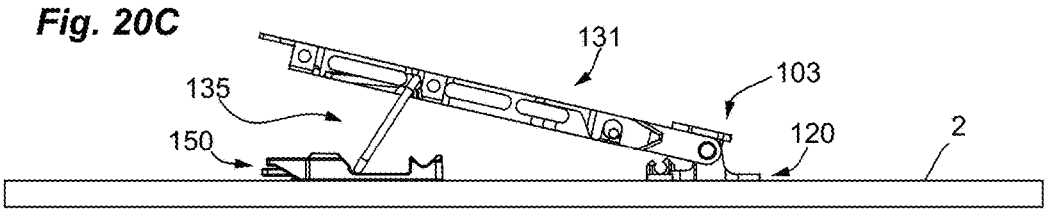
Figure 20D:
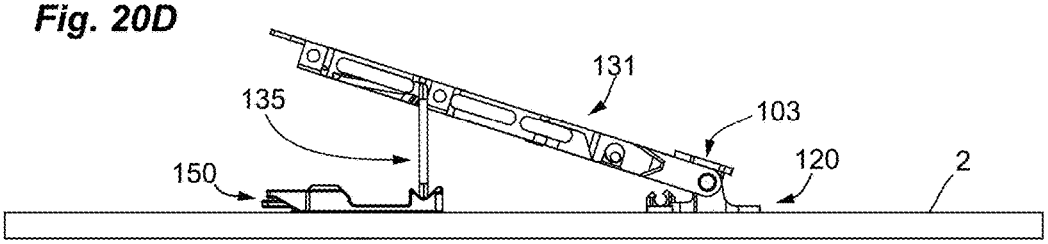

FIGS. 19A and 19B are perspective views showing the pivot and release feature of the pivot pedal 104 in ski mode. Thus in another aspect, the invention is a method for changing a boot binding from ski mode to ride mode with a single binding mechanism. The switch can be accomplished in less than twenty seconds, and comprises: a) lifting the foot latch pedal from a LOCK POSITION to a raised RELEASE POSITION, thereby disengaging the ski tour interface so that the pintle pins can be dismounted from the toe pivot cradle; b) moving the baseplate to a ride mode interface and sliding the baseplate onto a pair of mounting pucks, and, c) depressing the foot latch pedal from the RELEASE POSITION to the LOCK POSITION, thereby lockingly engaging the baseplate onto the ride mode interface. Similarly, the transition from ride mode interface to ski tour interface is performed by reversing these steps. FIGS. 4A-4B and 19A-19B illustrate the two interface transitions. The baseplate/foot pedal combination is enabled to be repositioned interchangeably, transitioning between either the ride mode (configuration 140) or the ski mode (configuration 131) and secured by using a single common foot latch pedal mechanism. Baseplate assemblies may be configured for right and left boots, or may be universal assemblies for either foot.

FIGS. 20A, 20B, 20C and 20D are elevation views demonstrating a range of pivot positions enabled. The ski tour interface 120 is mounted on the surface of a ski member 2. These views include a heel block 150 that is advantageous in stabilizing the climbing bar 135 and is made of lightweight plastic. In one embodiment as drawn in FIG. 20A, a free heel mode is enabled. A heel lock lever 151 is provided. In other embodiments, the binding system may be supplied with or without a heel lock mechanism. Multiple angulations are achieved by combining a single climbing wire with a heel baseplate having multiple detents, resulting in reduced weight. Deployment of the climbing wire is shown at several angles, ranging from zero in neutral (FIG. 20B) to about 12 degrees and about 18 degrees. These positions have proven their worth in field testing when ascending slopes.

Figure 21:
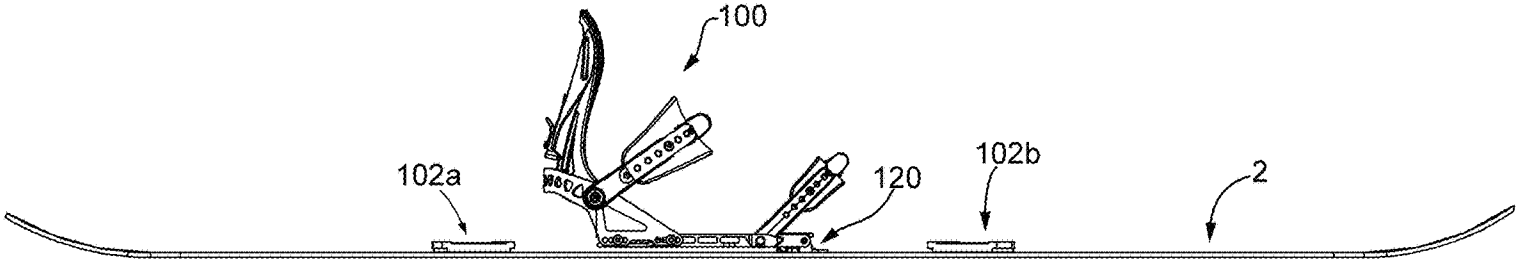
FIG. 21 is a rendering of a combination of a splitboard ski half in side view with boot binding in ski tour mode.

FIG. 21 is a rendering of a combination of a splitboard ski member 2 in side view and a boot binding 100. In this view the boot binding is reversibly locked onto a ski tour interface 120 and may be interchangeably transitioned onto ride mode interface members 102*a* and 102*b* when ski members are combined (joined at 1*b*) as a splitboard 1, as shown in FIG. 8.

The mechanics of the boot binding interaction with the rider's boot are described conceptually in FIGS. 22A through 24B. Material properties are discussed with respect to FIGS. 25A and 25B. Details of structure and materials are shown to be directed at achieving a "stiffer, lighter and lower" boot binding that improves performance for the rider, and is an advance in the art.

Structures of the boot binding are generalized to illustrate concepts used in increasing torsional stiffness for improving control and board feel in ride mode, reducing weight and lowering the boot sole elevation relative to the board, again to improve board feel and control. These principles apply here and were first described in U.S. Pat. Nos. 7,823,905, 8,226,109 and 9,022,412 to Ritter (as commonly owned). The objectives have been advanced by eliminating the insertable toe pivot pin, by substituting pintle pins 111*a*,111*b* and a lightweight plastic detent 106, by decreasing the mass of the boot sole platform while reinforcing the toe pivot nose, by eliminating the mass used for mounting a second climbing wire, by substituting a lightweight plastic heel block, by removing excess mass in the puck body, and by reducing girder mass except where loads are heaviest, as around the toe pivot and climbing bar mount, and around the climbing bar, which is load bearing in ride mode when stowed, and when deployed in ski mode.

Figure 22A:
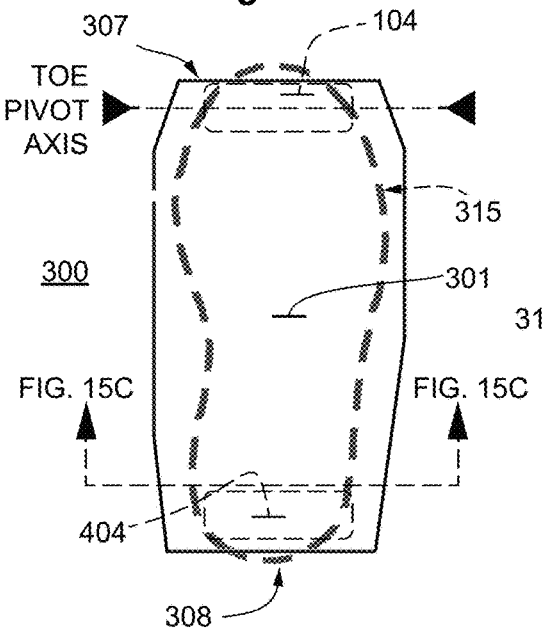
FIG. 22A is a schematic of plan view from the top of a modified π-girder with foot latch pedal.
Figure 22B:
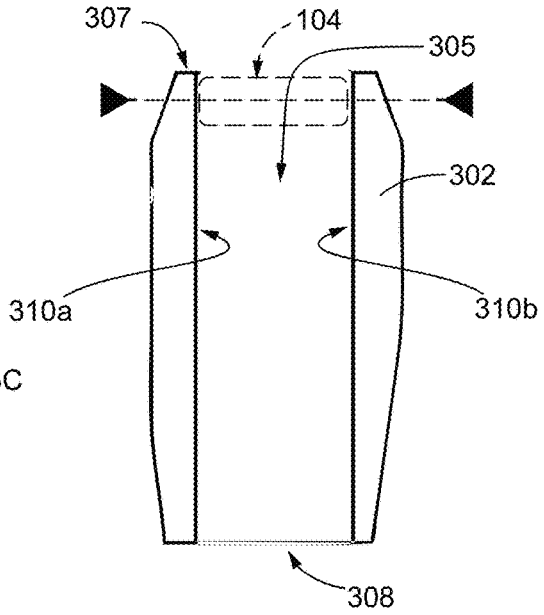
FIG. 22B shows the corresponding underside view.
Figure 22C:
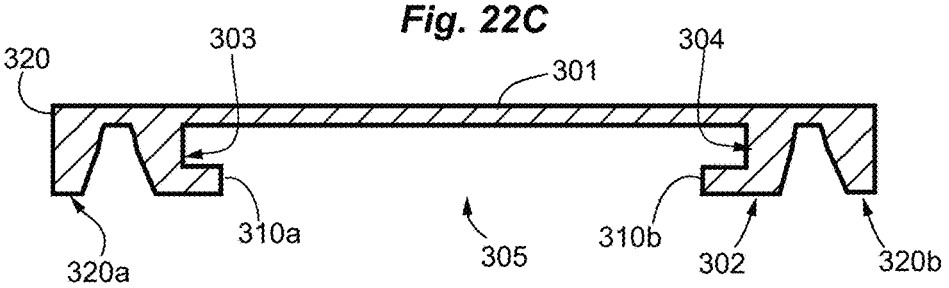
FIG. 22C shows the π-girder structure in cross-section.
Figure 22D:
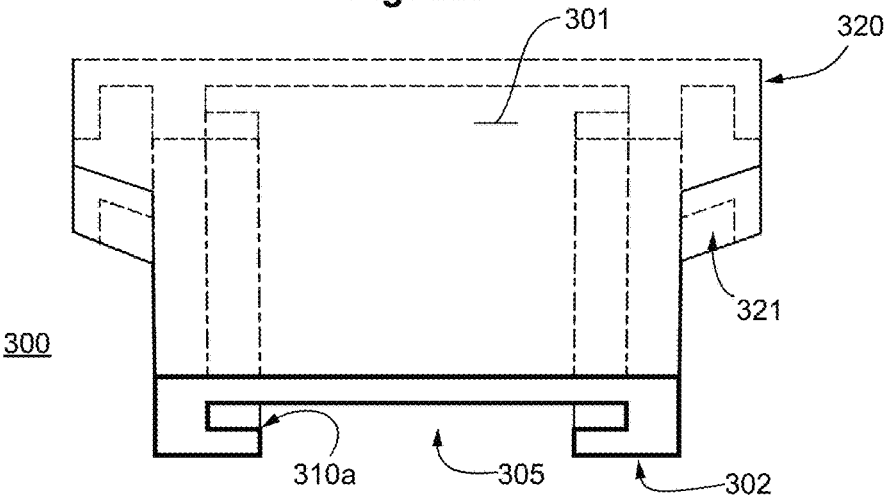
FIG. 22D is a simplified perspective view of a basic girder structure as viewed from the heel end.

FIG. 22A is a schematic of plan view from the top of a modified it-girder with foot latch pedal. FIG. 22B shows the corresponding underside view. FIG. 22C shows the π-girder structure in cross-section. And FIG. 22D is a conceptual perspective view of the basic girder structure as viewed from the heel end.

In FIG. 22A, a simplified plan view of a concept baseplate 300 showing the top plate 301 of a generally "n-shaped" girder is presented. The girder is defined by top plate 301, bottom plate 302, and lateral webs 303,304. The outline of the girder forming the baseplate may be tapered and complex if desired so as to more closely fit the rider's boot sole, which is supported by and seats on the top plate. The width of the boot binding is typically greater than the width of the rider's boot sole in outline (dotted line, 315). That is, the mediolateral edges of the boot binding are broader than the mediolateral edges of the boot sole. The boot, however, may extend past the heel and toe ends 307,308 of the girder if desired, as shown. In FIG. 22B, a plan view of the bottom plate 302 is shown. An open-ended underside channel 305 extends from the toe end 307 to the heel end 308. The channel is bounded laterally by parallel inside flanges 310*a*, 310*b*. The inside flanges grip and conjoin mounting blocks affixed to the splitboard in ride mode configuration. While the lateral dimensions and length of the channel are generally fixed, the top plate is dimensioned to suit the rider's boot.

Inside flanges 310*a*,310*b* and open underside channel 305 are again shown in section in FIG. 22C. The toe pivot axis is reinforced by outside extensions or wings 320*a*,320*b* of the girder (essentially a "double-webbed girder"); the extensions are slotted for attachment of a toe strap at the foot's maximal width. Lateral and medial web elements 303,304 are configured with an aspect ratio independent of the aspect ratio of the top and bottom plates and are configured so that the top plate is as low as possible relative to the board surface, while allowing room for the pucks, climbing bar, and heel block. The bottom surfaces of the medial and lateral flanges 302 of the bottom plate contact the top face of the splitboard during certain maneuvers but otherwise most of the bottom plate of the girder is removed. Serendipitously, the width between outside and inside edges 320*a*,320*b* results in a dramatic and dynamic increase in board control and responsiveness, as will be described further below.

Foot latch pedal plate 104 (dashed rectangle) is shown in a toeward position such that the detent member or element of the latch pedal mechanism abuts against a toe mounting block and is held under the toe of a rider's boot. Alternatively, the foot latch pedal plate 404 may be mounted at the heel end of the baseplate and a corresponding detent member or element abuts against a heel mounting block so that the the latch pivot is held under the heel of a rider's boot.

In a preferred embodiment, end stops at the heel end are eliminated and instead the climbing wire (FIG. 6, 135) captures the mounting pucks of the ride mode interface in the underside channel. The top plate is fenestrated where removal of metal does not compromise the needed stiffness, and in ride mode, the girder is stiffened by the engagement of the underside flanges with the corresponding flanges of the pucks.

Again shown is foot latch pedal plate 104 (dashed rectangle). The pedal replaces otherwise merely structural mass of the top plate with a functional mechanism for interchangeably engaging the ride and ski touring interfaces. And instead of a heavy axle, the pedal detent (FIG. 5, 106) is made of a tough but lightweight plastic that engages axle stubs (FIG. 5, 111*a*,111*b* "pintle pins").

FIG. 22D shows a conceptual perspective view from the heel end with side arms of the π-girder as needed to stabilize and reinforce the toe pivot axis. While formed around a "pi" girder structure with underside channel and flanges, the girder also comprises double-web expansion members 320 widened at the forefoot and toes for mounting the latch pedal plate and for securing the girder to the toe pivot cradle, where strength is needed at the toe pivot axis. The girder web is also fenestrated to reduce the overall weight but retains the characteristic strength of a π-girder.

Figure 23A:
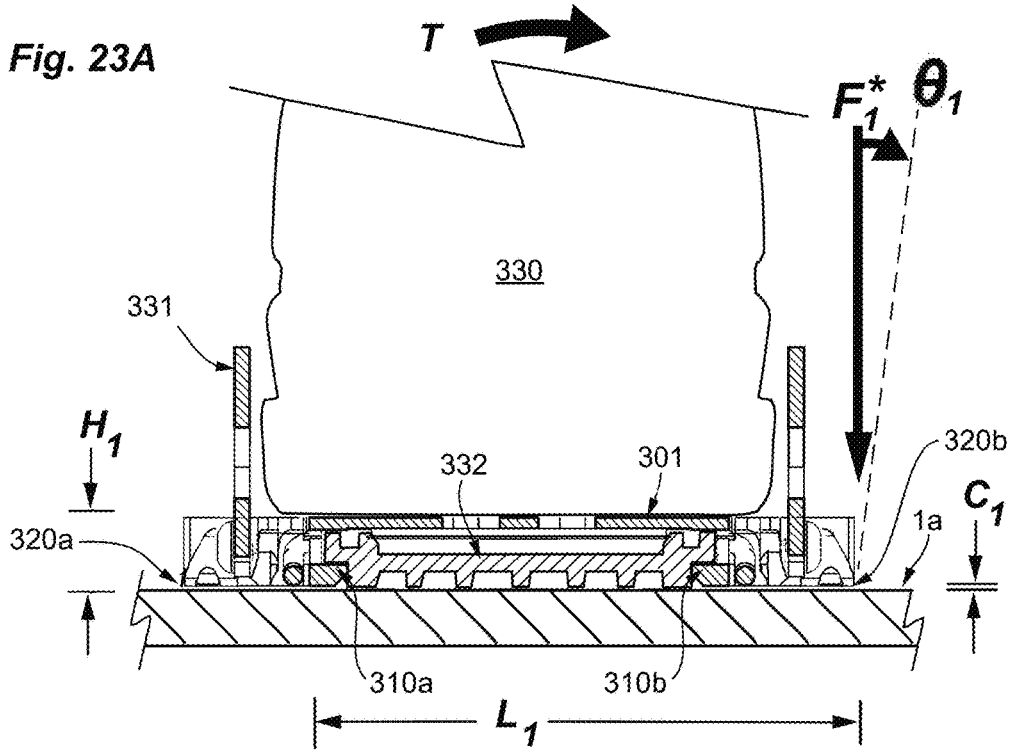
FIGS. 23A and 23B are comparative section views through the heel and ride mode interface of an exemplary binding of the invention (FIG. 23A) versus a representative binding of the prior art (FIG. 23B).

FIG. 23A is a cutaway heel view of a splitboard boot binding combination mounted on a ride mode interface. For comparison, FIG. 23B shows a view of a competitive boot binding combination on a prior art ride mode interface.

FIG. 23A analyzes the transmission of forces from the rider's boot 330 to the surface of a splitboard 1*a* for controlling the board in ride mode. Although shifting center of mass from one foot to another or from one side of the board to the other is one method for controlling the ride, another method is to apply a bending force through the ankles, which is illustrated here by a clockwise torque T. This technique of controlling the ride at the ankles is known as "foot roll" and is most efficacious when a requisite level of torsional stiffness in the linkage (or "coupling") between the boot and the board is provided. The rider proficient in use of foot roll to control the ride is able to comfortably and stably position their center of mass on the board and weight distribution between front and back feet; whereas a rider who must rely solely on shifting center of mass to control the board can be caught off balance and unable to recover. As can be seen in FIG. 23A, the rider's boot is in direct contact with the upper surface 301 of a boot binding (shown in section through a heel loop 331), here shown as a π-girder with underside internal flanges 310*a*,310*b* for engaging the corresponding external flanges of a puck (332, also a cut section). The torsional stiffness of the baseplate on the pucks is high, so that any adjustment can be made by relaxing the stiffness of the boot straps and boot. Heel loop and toe straps (not shown) are used to secure the rider's boot to the baseplate with an adjustable level of torsional stiffness. The toe strap is inserted through an outside slot (FIG. 14, slot 321) in the side wings of the baseplate. By starting from a stiff foundation, the bending force exerted by the rider is thus effectively transmitted to the splitboard. Torsional deformation is a form of stored energy; i.e., the boot binding functions as a spring. During an elastic recovery phase, the rider is returned to an upright position. Thus the spring constant of the binding is directly perceptible by the rider as "too much", "not enough", or in "the right range".

Torsional looseness also arises from excess clearances. The clearance $C_1$ between the bottom surface of the baseplate and the top face of the splitboard is sufficient so that the boot bindings can be slid on and off the mounting blocks (as in FIG. 6), but no more. Under dynamic load, the bottom flange edges 320*a*,320*b* are in contact with the underlying surface of the snowboard in snowboard riding mode and serve to communicate foot roll to the board, thereby providing for efficacious torsional stiffness during the ride. The tighter clearance ensures that the bottom surface of the girder reversibly (i.e., dynamically) contacts the face of the splitboard only if torque is applied to the bindings. Because of the reduced clearances, firm control is experienced when shifting foot roll from clockwise torque to counterclockwise torque T. Direct contact under load suppresses torsional "wobble" or "floppiness" in the linkage between the girder and the board, and the resulting torsional stiffness experienced by the rider is predominantly the spring stiffness K of the boot binding uppers and the boot itself. The linkage between the boot and the board under dynamic load becomes essentially a single rigid member. To the rider, the shift required to operatively contact the binding bottom surface with the board is almost unnoticeable. In the illustration, upon contact, clockwise torque T is applied directly to the board, the bending (twisting) force having a lever arm $L_1$ (FIG. 23A). The length of the lever arm $L_1$ is taken as a radius from the fulcrum $F_1$* or pivot point to the opposite side pair of interlocking flanges 310*a*, where deformation of the mounting block assembly is greatest. Because of the long lever arm, the angular deformation θ is reduced or suppressed. The fulcrum $F_1$* is the point at which a bottom mediolateral edge of the girder touches the splitboard face 1*a* when torque is applied. Torque T (clockwise) as shown here rotates the board at its axis of rotation relative to the foot of the rider; inside flange 310*a* of the boot binding lifts the rising edge of the external flange of the mounting block 332, which is a stiff but elastically deformable solid, and couples force down on the board to the right. Angular deformation θ of the mounting block is perceptible, imparting a certain level of "give" to the feel of control, but excess deformation is avoided. To control the ride, the rider reversibly contacts one or the other of the bottom mediolateral edges of the girder against the splitboard face by applying a clockwise or counterclockwise torque through the boot sole; that reversible contact effectively increases the torsional stiffness of the boot binding by reducing the applied forces and deformation or flexural compliance of the mounting blocks to an efficacious level, thus allowing the rider's bending motion to aid in control of the splitboard rather than excessively deforming the mounting block. The rider's perception is one of increasing, decreasing or reversing the "bite" of one edge of the board. The longer lever arm $L_1$ results in less deformation of the mounting block, resulting in better control and balance for the rider. By "efficacious level of flexural compliance" is meant a perception of control without "wobbliness" or "floppiness" in standing on the board while riding: the board "feel". This can be quantitated by mounting any boot binding on a splitboard in a jig and measuring the rotational angle θ under an applied torque T. The torsional spring stiffness constant K is determined by finding the slope of AO versus torque (Equation 1). By using a longer lever arm $L_1$ as shown in FIG. 23A, sufficient torsional stiffness to control the ride is readily achieved within acceptable levels of flexural deformation of the mounting blocks (data is supplied in EXAMPLE 2 and EXAMPLE 3). Acceptable levels are generally greater than 150 in-lbs/degree, or in the range of 150-350 in-lbs/degree.

Figure 23B:
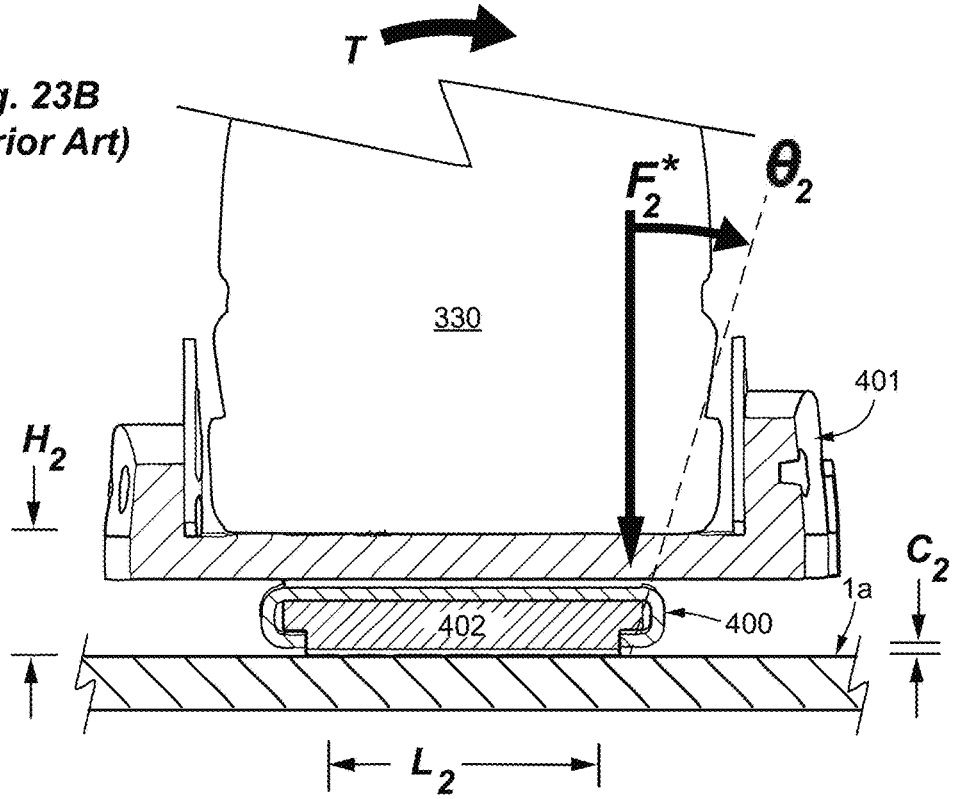
Fig. 23B (Prior Art)

While initially described as increasing the stiffness relative to the prior art binding described in FIG. 23B, field experience has shown that there is a critical range for torsional stiffness that is an engineering challenge to achieve. The desired spring constant of the binding/ride mode linkage is in the range of 150-350 in-lb/degree, more preferably 180-280 in-lb/degree, and this is not generally a rider preference, but rather is the needed stiffness to control the board without under- or over-correction. Structurally, this is achieved by reducing the torsional spring member subassembly to the baseplate as a girder, the mounting puck flanges, the underside bottom flanges of the mediolateral girder rails, and the fulcrum established when the girder rails are contacted to the splitboard top surface. FIG. 23B is taken as an illustration of a structure having a stiffness coefficient that is too low.

For instance, any looseness in the play of the boot binding makes it difficult to recover from a sudden loss of balance, for example a rider who jumps and comes down on the tail of the board. In this case, the spring constant K in the boot bindings will help propel the rider back into an upright position relative to the board as the tail bottoms out. The feeling of being "tied in" to the board is lost if the boot binding stiffness is insufficient. Without sufficient stiffness in the boot binding, the board will seek its own level and the rider will be unable to regain balance. To solve this problem, excess torsional play in the coupling between the girder and the board is eliminated and the rider is then free to select a preferred torsional stiffness in the boot binding uppers and by selection of soft boots with a desired composite stiffness coefficient.

Thus in another embodiment, the invention includes methods for controlling the ride of a splitboard by optimizing the torsional stiffness of the boot bindings. The torsional stiffness may be controlled dynamically by reversibly contacting either of the bottom lateral edges of the girder with the board face. The steps of a method for controlling the ride may include a) mounting a boot binding of the present invention on a splitboard, where the splitboard is provided with paired mounting blocks for mounting the boot binding on the top face of the board, and the boot binding comprises a modified monolithic π-girder having a top surface and top mediolateral edges configured for contactingly supporting and securing a rider's boot sole, and a bottom surface, the bottom surface having a pair of internal flanges forming a underside channel and a pair of bottom mediolateral edges, where the bottom surface and the top surface are joined as a single rigid member, and the bottom surface and channel are configured with a clearance or clearances for slidingly engaging the paired mounting blocks; and b) while riding the splitboard, a step for reversibly contacting either one of the bottom lateral edges against the splitboard face by operatively applying a clockwise or counterclockwise torque through the boot sole, whereby the rider's boot sole and the board face are dynamically coupled for the duration of the contact step. Preferably, the single rigid member has a lever arm $L_1$ that extends from the fulcrum F* to the furthermost interlocking flanges of the mounting blocks. This single rigid member is the modified π-girder and the lever arm for purposes of analyzing the torque is a radius drawn through the girder from the fulcrum or pivot point at a bottom mediolateral edge to an opposite edge of the mounting blocks where deformation is maximal. This extended lever arm and single rigid member construction, in contrast to the short lever arm $L_2$ and mechanical stack of FIG. 23B, dynamically suppresses the flexural compliance of the mounting blocks and eliminates compliances and tolerances associated with the complex mechanical stack of the prior art. The boot binding is operatively reduced upon dynamic application of torque to a single rigid member between the sole of the rider's boot and the splitboard. In a preferred embodiment, the modified π-girder with foot latch pedal, climbing wire, and modified pucks is demonstrated to provide torsional stiffness at a critical range or "sweet spot" as defined above.

In contrast, in the prior art boot binding of FIG. 23B, shown here for comparison, multiple members of a mechanical stack with additive compliances and clearances separate the boot 330 from the board 1*a*. These additive compliances and clearances result in both an inelastic flexural compliance and an elastic flexural compliance that is excessive and undesirable. The rider experiences an unacceptable loss of control due to the wobbliness and floppiness of the mechanical stack. As can be seen, for boot binding baseplate 401 when mounted on puck 402, the slider track coupling 400 cannot readily contact the board due to the excessive clearance $C_2$ between the lower edges of the slider track and the top face of the board and due to the narrow width of the mediolateral bottom edges of the plate. As the slider track 400 angulates, the mounting blocks 402 are deformed by a combination of bending and compression, with a center of rotation ($\Delta\theta_2$) within the mass of the mounting block. While difficult to be precise, the rotation $\Delta\theta_2$ under torque can be analyzed as a shorter lever arm $L_2$ rotating around a fulcrum $F_2$*laterally disposed in the mounting block. This shorter lever arm $L_2$ increases the amount of rotational deformation required to achieve a requisite clockwise torque T for control of the ride and may require displacing the rider to a point where the center of mass is not in the desired location, i.e., to lose balance, further reducing control. While the clearance $C_2$ is thought to protect the aesthetic appearance of the splitboard face, the clearance also increases the side-to-side play in the mechanical stack. Furthermore, the increased height $H_2$ of the boot sole above the board combines with the play in the mechanical stack to increase the feeling of instability. Contrastingly, the reduced height $H_1$ shown in FIG. 23A improves the sense of control achieved by the modified π-girder and pucks.

Figures 24A, 24B:
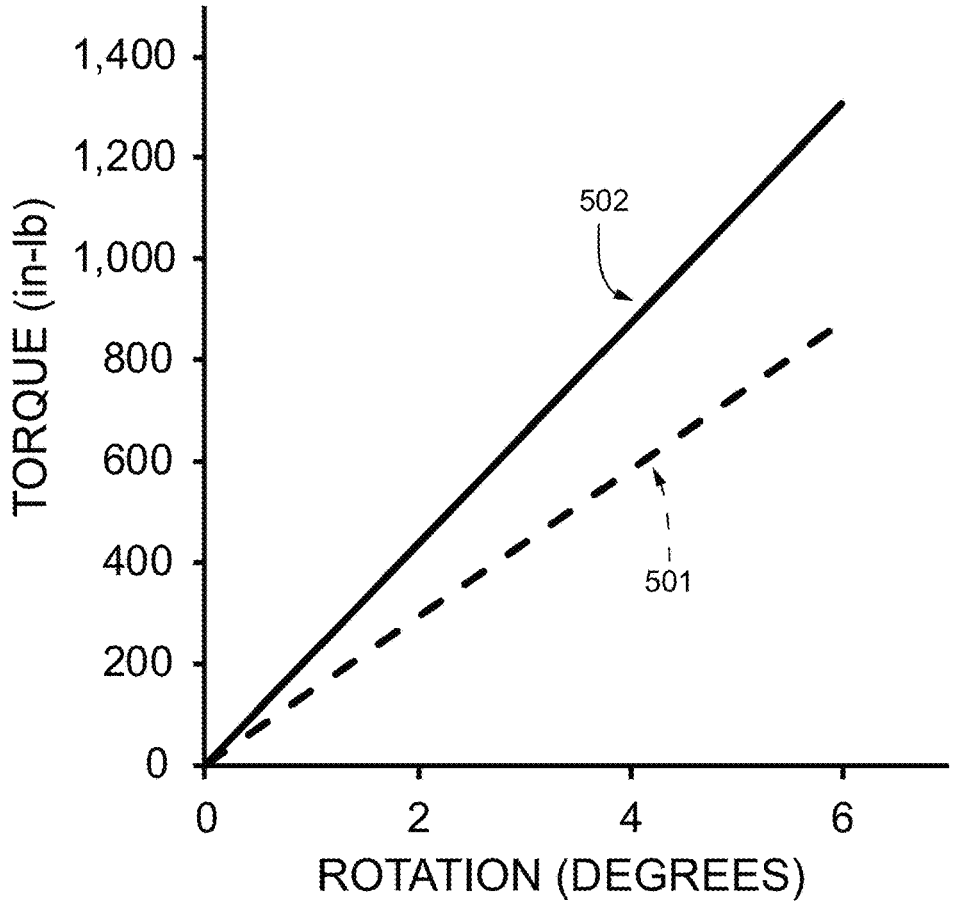
FIG. 24A is a plot of torque versus rotation, in which the slope is the torsional spring constant, comparing an exemplary article versus a representative prior art article.
FIG. 24B tabulates the torsional stiffness constants as experimentally measured.

FIG. 24A is a plot of torque versus rotation, in which the slope is the torsional spring constant, comparing an exemplary article 502 versus a representative prior art article 501. FIG. 24B tabulates the torsional stiffness K as experimentally measured.

FIG. 25A is a plot of the weights of several generations of boot bindings having one or more features of the inventive bindings. The weight progressively approaches a threshold of 1 kg per boot binding pair, as is nearing the threshold in the Arc binding (601, Spark R&D, Bozeman MT). A trendline is evident, with a breakthrough most recently at 602. These are discussed in more detail in the examples that follow.

Figure 25B:
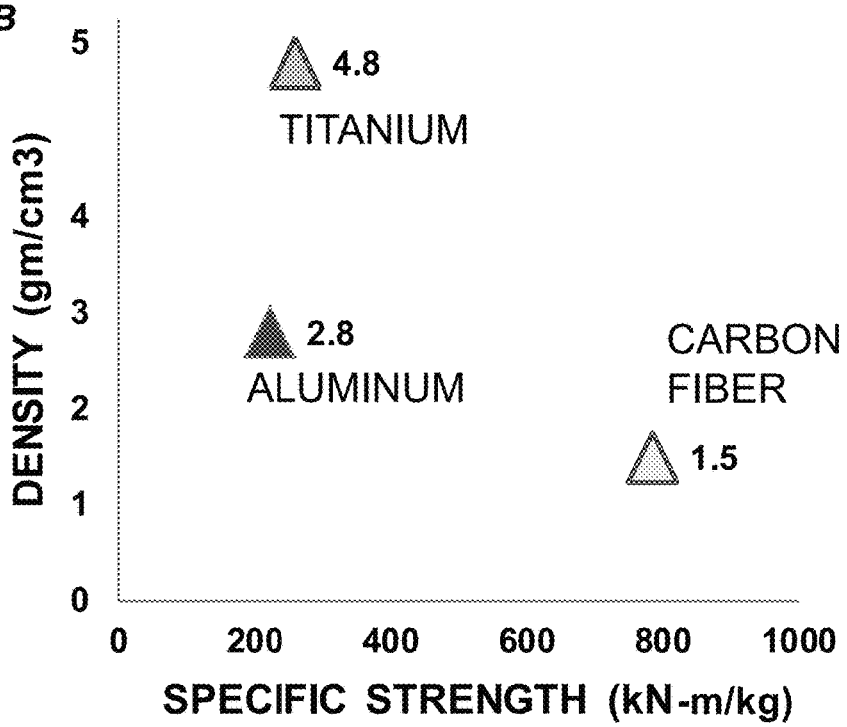
FIG. 25B is a plot of material density versus specific strength.

FIG. 25B is a plot of material density versus elastic modulus as expressed as specific strength. The implications of this plot are discussed in more detail in the context of the examples that follow.

Ritter, in U.S. Pat. Nos. 7,823,905, 8,226,109 and in US Pat. Appl. Publ. No 2013/025395, solved the problem of a stiffer, lower and lighter binding for ride mode. This has been improved here for ski mode and ride mode by reducing the weight of the baseplate and increasing stiffness across the width of the forefoot. Toe jaw members of the π-girder are modified and the foot latch pedal mechanism is implemented for locking the baseplate to the ski touring and ride mode interfaces. The greater stiffness at the toe pivot axis also improves durability of the ski mode configuration and the reduced weight aids in reducing fatigue when skinning or touring on the skis.

Example 1

For prototyping, a Drake F-60 snowboard binding with removable or fastened heel loop and highback was modified in a shop by removing the upper binding and 4-hole disk and substituting in their place a sheet of 2.5 mm aluminum with side rails folded up to form a shallow channel for the boot.

A three dimensional CAD design was sent to a local sheetmetal house that used a CNC (computer numerically controlled) laser cutter to cut the outline and holes for the aluminum parts necessary for the bindings. Sheetmetal press brakes were then used to bend the channels of the bindings. Similarly, a CNC milling machine cut out UHMW polyethylene spacers from a sheet of 16 mm thick plastic. This machine provided all holes, the outline, and contoured surfaces.

Using mounting bolts, the heel and toe straps and highback were secured in place. A total of ten screws, countersunk, were placed at the circumference of the base along each side of the sandwich to secure the plastic spacer materials (webs) in position between the aluminum plates.

A milled hole accommodates a longer pivot pin than used in the prior art, and a second smaller hole was placed in the aluminum side rails to secure a braided cable loop to protect against loss of the snap fasteners. Note that the inner dimensions of the channel formed by the plastic spacers is wide enough to snugly fit over the ski mounting tabs and that the transverse pivot axis lines up with the hole in the ski mounting bracket. UHMWPE lubricates the pin and spares wear on the pivot pin cradle mount.

Right and left boot bindings were made in this manner. To assemble the splitboard, the boot bindings are securely slid over the splitboard mounting blocks and locked in place with the transverse pin and snap fasteners. To switch to ski mode, the boot bindings are slipped off the splitboard mounting block assemblies and positioned at the toe over the ski mounting cradle so that the pivot pin can be aligned through the pivot holes and secured in place with snap fasteners. This was tested in actual use and found to offer a more positive and responsive board feel. In subsequent manufactured versions, improved integration, material selection, and weight reduction was practiced, contributing to what is at time of this filing a "best mode" as shown in FIGS. 1 and 12.

Example 2

Mechanical comparisons were made using a splitboard and boot binding assembly of the prior art versus that of Example 1. A Voile "Splitdecision 166" splitboard was used for the comparisons, and for the prior art testing, Drake F-60 snowboard bindings were mounted as recommended by the manufacturer on the Voile mounting hardware. The boot bindings were assembled in snowboard riding configuration for these comparisons.

Physical measurements of the two boot bindings on their interfaces were also made and are recorded in Table I.

TABLE I

| | Prior Art | Example 1 |
|---|---|---|
| Distance from plane of board to bottom of boot | 26 mm | 14 mm |
| Width in contact with board under lateral load | 80 mm | 120 mm |
| Weight per boot binding | 1182 g | 1015 g |

To measure deformation under lateral strain, which is related to spring constant K of the boot bindings, the splitboard was clamped to a vertical surface so that the highback of the boot bindings were mounted parallel to the floor. An 11.3 kg weight was then clipped onto the top of the highback, and the angle of shear for the two assemblies was compared. Deformation under modest lateral loading was approximately 36% greater with the prior art boot binding, indicating an unacceptably low torsional stiffness. The degree of torsional stiffness in a boot binding is indicated by the degree of angular deformation under increasing lateral strain applied at the top of the boot. Ideally, the "spring constant" of the torsional stiffness relationship is relatively constant and linear through the required range of flexural deformation. "Torsional weakness" or "looseness" can result from excessive compliance in elastic parts, both with respect to materials selection and with respect to design, from excess tolerances when parts stack up, and from excess height of a parts stack.

The binding system of EXAMPLE 1 was noted to substantially increase lateral stiffness of the boot and to lower the center of gravity on the boot. In snowboarding tests undertaken during winter conditions on mountainous terrain, the increased lateral rigidity of the inventive bindings was found to result in immediately noticeable increases in control and responsiveness of the board in downhill ride mode.

Improvements were also noted in telemark and ski touring, which were attributed to the improved toe contact made by the boot with the board, particularly for kick turning, and the wider lever arm on the bracket.

Weight was reduced by 6 ounces (170 g) on each foot, a 15% weight savings. This weight savings noticeably decreases the effort required to ascend a slope because the weight on each foot must be repeatedly lifted and pushed forward. This weight savings is obtained by eliminating or combining unnecessary and redundant structures like the four-hole disk of the prior art. The four-hole disk adds the ability to adjust the stance angle on a conventional snowboard and is the principal component that determines the thickness of the tray. However, with a splitboard, the plastic pucks also allow rotation of stance during setup, making the adjustability of the 4-hole disk redundant. Voile (Salt Lake City, Utah), manufacturer of the snowboard mounting block assemblies used in these tests, states that the binding should always be connected to the slider track at zero degrees. This prototype fuses these structures at zero degrees without the added weight and thickness of a four-hole disk.

Example 3

A torsional stiffness coefficient was measured for the boot binding related to that of FIG. 23A and compared to an equivalent measurement for a binding of the prior art (FIG. 23B). However, in order to eliminate the contribution of the upper baseplate, four hole disk and gasket of the prior art, these were eliminated from the test setup. To make the measurement, a lever arm consisting of a block of aluminum 7.7 inches long by 2.5 inches by 2.5 inches wide was bolted to the slider track 400 of the prior art setup or to the top plate member 301 of an inventive article. A block and tackle was used to apply a force on the lever arm, which generated a torque on the binding. An angle gauge was mounted on the aluminum block to measure theta. Both boot bindings were mounted on identical mounting blocks which had been affixed to a splitboard for the test. The splitboard was clamped to a solid support. Deformation (as torsional rotation) versus torque was then measured. The data is plotted in FIG. 24A and summarized in Table II (FIG. 24B).

As expected, torsional stiffness was not equivalent. The slope of the data points is the torsional stiffness spring constant K. A slope 502 of about 220 inch-pounds/degree was observed for the inventive article. About 1400 inch-pounds of torque was required to achieve 6 degrees of rotation ($\theta_1$) of the binding. In contrast, the torsional stiffness of the prior art article 501 was about 145 in-lbs/degree. A torque of 870 in-lbs resulted in 6 degrees of rotation of the binding; 1400 in-lbs resulted in a deformation of almost 10 degrees of rotation ($\theta_2$). The data are tabulated in FIG. 24B. The inventive design thus achieves about a 50% increase in torsional stiffness at the level of the mounting blocks. The increase is attributed not to any difference in the mounting blocks, which were identical for the test, but due to the increased width of the bottom plate flanges of the boot binding. In the case of the inventive article, the bottom plate flanges actually touch the board whenever torque is applied. The lower edges of the article of the prior art was never seen to touch the board. The extended base width can be analyzed as moving the fulcrum ($F_1$*, see FIG. 23A) for rotation away from the applied force, thus stiffening the binding.

In the prior art article (see FIG. 23B) the fulcrum $F_2$* is seen to be closer to the applied force, and an equivalent force results in a much greater rotational deformation $\theta_2$ of the mounting blocks. During the testing, the bottom edges of the prior art slider track were not observed to touch down on the face of the board.

A stiffer boot binding lower is achieved by the inventive bindings. The torsional stiffness of the overall boot binding is a combination of the K factor for the baseplate and corresponding K factors for the boot binding uppers and the boot itself. Each K factor represents a torsional spring element, or a combination of spring elements. Thus a boot binding baseplate that lacks sufficient torsional stiffness undermines the stiffness of entire boot binding and boot as a whole.

In ride mode, the board is controlled by the bite of its edges in the snow. The rider turns by relocating pressure from one side of the board to the other as well as from jaw to tail. Toeside and heelside turns on a snowboard involve a complex combination of dorsiflexion and plantar flexion, plus the roll of the calcaneus, talus, and subtalar joint, nosewise and tailwise on the board. While these motions would seem to be favored by a completely loose binding, in fact, an optimal torsional binding stiffness is required. Torsional stiffness is the spring force in the bindings that opposes the rider's motion. This opposing force translates the rider's motion into pressure on the desired section of the board. When the rider cuts downslope, for example, the boot bindings transmit pressure onto the jaw of the board. When the rider bends upslope, the boot bindings transmit pressure onto the tail of the board. Similar forces come into play as the rider bends toeside or heelside. If the bindings lack torsional stiffness, the ability to apply control pressure to the intended segment of the board is decreased. Torsional looseness is felt as "play", "slop" and instability. Conversely, if the bindings are too stiff, the legs cannot pivot, and the rider loses balance and control. Therefore, there is a critical stiffness that provides an optimal mix of freedom of motion and responsive board control. To achieve freedom of motion, a boot binding is made to be stiffest at the base and mechanical stack where coupled to the board and becomes less stiff toward the ankle and calf or knee. For example the heel loop can be configured to provide an intermediate level of stiffness, and the highback a modest but perceptible stiffness, but if the boot binding/splitboard coupling itself has a low torsional stiffness, then no net positive effect on the composite stiffness K in ride mode can be achieved by wearing stiffer boots or reinforcing the highback, for example.

Torsional deformation is a form of stored energy; i.e., the boot binding functions as a spring. During an elastic recovery phase, the rider is returned to an upright position. Thus the spring constant K of the binding is directly perceptible by the rider as "too much", "not enough", or in "the right range". There is a sweet spot; a critical stiffness. The rider can adjust the upper spring constant by selecting a boot and boot binding uppers such as heel loop, highback, and ankle strap, but only within limits, and not in the mechanical stack that couples the base to the board. When the upper baseplate, gasket, and four-hole disk of the prior art are also included with the prior art binding, and K is again measured, K can quickly fall below 70 in-lb/degree. Compliance or "play" in this range is experienced as acute "wobbliness". With typical setups of the prior art at the time, K's of 32-70 in-lb/degree were measured—too low for good performance. Through a long process of trial and error, I have discovered that a preferred range of stiffness K (as a composite K, including boots, heel loops, and boot straps) is in the range of 70 to 130 in-lbs/degree, and a preferred range of stiffness of the boot binding baseplate on the board is higher, 150 to 300 in-lb/degree, and more preferredly 180-270 in-lb/degree. This is fundamentally a matter of physics but the critical range must be discovered through extensive trial and error.

Example 4

As shown in FIG. 25A, multiple variants of the inventive binding have been made and field tested extensively. A representative binding and its variants (FIGS. 1-21), having a foot latch pedal structure, a single climbing wire, and related improvements in the π-girder, is shown to have exceptionally low weight 601 under standard measurement conditions.

The Arc boot binding (Spark R&D, Bozeman MT) has proven very stable in both ride mode and ski mode and weighs in at 681 gms per binding. It is made by CNC milling from an aluminum alloy block and is representative of the articles shown in FIGS. 1-21.

To make a yet lighter binding, carbon fiber block of 14 mm thickness is CNC milled to the same pattern as the Arc boot binding. Given the lighter density of the material, the resulting dramatic reduction in weight for the carbon composite binding realizes a long sought goal of a boot binding pair having an overall weight 602 of less than a kilogram per pair. With metal and plastic composites (such as metal bushings and inserts to support the pintle pins and climbing wire) bindings having a weight of less than 1.0 kg are achieved. Binding pairs in a weight range of 0.5 to 1.2 kg offer an optimized combination of lightness and durability. Metal tolerates cyclical loads better than a fiber composite, although improvements are being made for example with newer fillers such as PNP (polyacrylonitrile) and by microwave conditioning of the finished product. Other fibers such as polyaramids are also of importance in reducing weight without loss of strength and resilience. Alternatively, spooled carbon fiber composite are available for a three dimensional printer and a prototype binding from the drawings presented here is made by 3D-printing. In yet another alternative, molded parts are manufactured from composite materials. Inserts for receiving threaded fasteners, pins and journaled shafts are molded in place or placed after the molded part is formed. Bushings may be used. In one instance, the molded part is a boot binding baseplate, in other instances, a mounting puck, according to the desired torsional spring constant of the combination.

Surprisingly, reduced weight is not sacrificed at the expense of torsional stiffness, yield strength or modulus of elasticity. Taking the "specific strength" ($S_q$, the ratio of elastic modulus and density) as an index, FIG. 25B shows that carbon fiber composites (here an epoxy composite) has a greater specific strength (785 kN-m/kg) than either aluminum (222 kN-m/kg) or titanium (260 kN-m/kg) and is also about half the weight of a common aluminum alloy. Exotic alloys such as 7086 aluminum-zinc alloy are not considered here. Interestingly, there is little advantage in specific strength by using titanium over aluminum. The gain in specific strength by going from aluminum to titanium is only about 14%, although weight as density doubles.

Carbon fiber epoxy composite has a density of 1.4 to 1.7 $gm/cm^3$; a representative aluminum alloy has a density of 2.8 $gm/cm^3$, and a representative titanium alloy a density of 4.8 $gm/cm^3$. Thus by a process of extensive and complex experimentation, a boot binding with modified π-girder, underside channel, and toe with latch pedal mechanism for receiving a ride mode interface or a ski mode interface has now achieved what had been thought impossible and unobtainable, a boot binding pair weighing less than or equal to one kilogram. When it is considered that an epoxy composite splitboard may weigh 2.7 kg (Jones Snowboards, Truckee, Calif.) when layered with 2× Textreme carbon (TXC) fiber materials, the reduced weight of the boot bindings disclosed here finally begins to free the rider from the exhausting challenge of touring, hiking and skinning up a mountain with three, four, or more kilograms strapped to each foot, particularly when faced with a long ascent. It is known that each kilogram removed from the foot decreases energy expenditure 7% to 10%. Weight on the feet requires roughly four times the exertion to move as the same weight carried in a backpack. Thus the teachings presented here represent an advance in the art and are novel and surprising to those skilled in the trade.

While there is provided herein a full and complete disclosure of more than one preferred embodiment of this invention, various other modifications, alternative constructions, changes and equivalents will readily occur to those skilled in the art and may be employed ad libido, without departing from the true spirit, concepts and scope of the invention. For example details may be provided such as by reversing the position of the pedal latch from toewise to heelwise without departing from the inventive concepts. Such changes may involve alternative materials, components, structural arrangements, sizes, shapes, forms, functions, operational features, or the like. The various embodiments described above can be combined to provide further embodiments. Therefore, the scope of the present invention should be determined not with reference to the above description but should, instead, be determined with reference to the appended claims, along with their full scope of equivalents, and any amendments made thereto, and in earlier filings in which other embodiments were claimed and in future filings in which other embodiments may be claimed as would be obvious to one skilled in the art. Accordingly, the claims are not limited by the disclosure.

INCORPORATION BY REFERENCE

All of the U.S. Patents, U.S. Patent application publications, U.S. Patent applications, foreign patents, foreign patent applications and non-patent publications referred to in this specification and related filings are incorporated herein by reference in their entirety for all purposes. This continuation-in-part claims benefit of priority to parents U.S. Pat. Application Ser. Nos. 61/757,216, 14/815,432, (now U.S. Pat. No. 9,126,099), and Ser. No. 14/815,432, entitled "Boot Binding System with Foot Latch Pedal", and benefit of U.S. patent application Ser. Nos. 11/409,860, 12/483,152, and 13/527,358, titled "Splitboard Bindings", owned by a common owner, for all that is taught, both said earlier applications having been incorporated by reference as filed.

REFERENCE NUMBERS OF THE DRAWINGS

1 splitboard having two halves
1*a* top face of a splitboard
1*b* split junction of a splitboard
2 ski half of a splitboard as a pair
2*a* first ski half of a splitboard
2*b* mating second ski half of splitboard
100 exemplary boot binding with heel loop, highback, and straps
101 baseplate
101*a* underside channel
101*b* cutout in baseplate
102 mounting puck, singular
102*a*/102*b* ride mode interface/first and second mounting pucks as pair
103 foot latch pedal mechanism
104 foot pedal plate
104*a* top face of foot pedal plate
105 hinge arms of foot pedal plate
106 detent member or element
107 offset hinge pin of latch pedal assembly
107*a*/107*b* First and second foot latch pedal hinge pins
108 anterior jaw members, contralaterally disposed
108*a*/108*b* anterior jaw members as pair
109 mounting box slot defined between anterior jaw members
110 baseplate/latch pedal combination
111 pintle pin
111*a*/111*b* first pintle pin and second pintle pin
120 ski mode interface/toe pivot mounting cradle with toe pivot ears
121 bushings of toe pivot ears
122 toe pivot ear
130 baseplate/latch pedal assembly with ride mode interface
131 boot binding baseplate system in ski mode configuration
135 climbing bar
140 boot binding baseplate system in ride mode configuration
150 heel block
151 heel lock lever
300 simplified boot binding baseplate with boot sole outline
301 top face of baseplate
302 bottom face of baseplate
303,304 webs of π-girder
305 underside channel
307 toe end of baseplate
308 heel end of baseplate
310*a*,310*b* inside flanges of an underside channel of a it-girder
315 outline of boot sole
320 forefoot side extensions of π-girder
320*a*/320*b* medial and lateral outside bottom edges of a π-girder
321 outside channels for receiving toe strap
322*a*,322*b* lateral posts for heel loop of exemplary binding
323*a*,323*b* toe pivot receiving holes of exemplary binding
324*a*,324*b* web members of exemplary binding girder
325*a*,325*b* internal underside flanges of exemplary binding
326*a*,326*b* medial and bottom rails of bottom plate of exemplary binding
330 soft boot
331 heel loop

332 mounting block or puck of a "best mode" article
333 puck flanges of a representative boot binding baseplate
334 puck retainer
400 slider track of prior art article
401 baseplate of prior art article
402 mounting block or "puck" of prior art article
404 alternative latch pedal plate with detent
501 Torsional stiffness curve for a prior art article
502 Torsional stiffness curve for an exemplary article
601 Weight of a first boot binding of the invention
602 Weight of a second boot binding of the invention

I claim:

1. A boot binding and interface system for a splitboard, the boot binding and interface system configured to receive each of a rider's boots, the splitboard including two ski halves, the boot binding and interface system, comprising:

a ski tour interface configured to ride the two ski halves in a ski mode, and a ride mode interface configured to rigidly conjoin and ride the two ski halves in a ride mode; and a baseplate-latch pedal combination comprising:

a) a boot binding baseplate including a top surface, an undersurface, a heel aspect, a toe aspect, the top surface is configured to secure a boot of the rider's boots, the heel aspect is configured for supporting a boot heel of the boot on the top surface thereof, and the toe aspect comprises a mounting box slot defined by an anterior open end, a posterior closed end, and contralateral jaw members of the boot binding baseplate;

b) a foot latch pedal comprising a toe plate, the toe plate including a top face, an underside, a heel end, a toe end, the heel end is pivotably affixed to the heel aspect of the mounting box slot, and the toe end comprises a detent member disposed thereunder, the foot latch pedal including:

i) a release position in which the detent member is pivotably angled up from and out of the mounting box slot; and, ii) a lock position in which the toe plate is essentially level with the mounting box slot, the top surface of the boot binding baseplate and the top face of the toe plate cooperatively defining a heel-to-toe foot supporting surface, the detent member is configured to lockingly engage the ski tour interface in the ski mode and the ride mode interface in the ride mode.

2. The system of claim 1, wherein the ski tour interface comprises a pair of toe pivot ears mediolaterally disposed on each of the two ski halves, each toe pivot ear of the pair of toe pivot ears including a coaxial pivot hole disposed therethrough, and the contralateral jaw members of the boot binding baseplate each comprise a toe pivot pintle pin ipsilaterally disposed thereon, the toe pivot pintle pin defining a toe pivot axis when cooperatively inserted into the coaxial pivot hole of a corresponding toe pivot ear of the pair of toe pivot ears in the ski mode.

3. The system of claim 1, wherein the ride mode interface comprises a pair of mounting pucks for receiving each the boot binding baseplate in the ride mode.

4. The system of claim 3, wherein the undersurface of the boot binding baseplate comprises a channel having internal flanges for slideably receiving and conjoinedly gripping the pair of mounting pucks.

5. The system of claim 3, wherein:

the underside of the boot binding baseplate comprises a channel; and the detent member is configured to lockingly capture the pair of mounting pucks in the channel when the foot latch pedal is in the lock position.

* * * * *